US007909443B2

(12) United States Patent
Hirato

(10) Patent No.: US 7,909,443 B2
(45) Date of Patent: Mar. 22, 2011

(54) INKJET RECORDING APPARATUS

(75) Inventor: Katsuyuki Hirato, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 787 days.

(21) Appl. No.: 11/863,386

(22) Filed: Sep. 28, 2007

(65) Prior Publication Data

US 2008/0079792 A1 Apr. 3, 2008

(30) Foreign Application Priority Data

Sep. 29, 2006 (JP) ..... 2006-269250

(51) Int. Cl.
*B41J 2/175* (2006.01)

(52) U.S. Cl. ..... 347/85; 347/92

(58) Field of Classification Search ..... 347/5, 17, 347/84, 85, 92
See application file for complete search history.

(56) References Cited

U.S. PATENT DOCUMENTS

| | | | | |
|---|---|---|---|---|
| 4,301,459 | A * | 11/1981 | Isayama et al. | 347/19 |
| 4,680,368 | A * | 7/1987 | Nakamoto et al. | 528/49 |
| 5,875,615 | A * | 3/1999 | Ito et al. | 53/474 |
| 6,059,405 | A * | 5/2000 | Mochizuki et al. | 347/92 |
| 6,203,146 | B1 | 3/2001 | Pawlowksi, Jr. et al. | |
| 6,312,119 | B1 * | 11/2001 | Kocher et al. | 347/92 |
| 7,344,230 | B2 * | 3/2008 | Moynihan | 347/85 |
| 2004/0135858 | A1 | 7/2004 | Usui | |
| 2005/0140753 | A1 | 6/2005 | Tsukahara et al. | |
| 2006/0050112 | A1 | 3/2006 | Moynihan | |
| 2006/0185587 | A1 | 8/2006 | Shang et al. | |

FOREIGN PATENT DOCUMENTS

| | | | |
|---|---|---|---|
| EP | 1574553 | A1 | 9/2005 |
| GB | 2402908 | A | 12/2004 |
| JP | 5-017712 | A | 1/1993 |
| JP | 2004-196936 | A | 7/2004 |

OTHER PUBLICATIONS

Extended European Search Report for European Patent Application No. 07018801.6-1251/01905597, dated Jul. 15, 2009.

* cited by examiner

*Primary Examiner* — Anh T. N. Vo
(74) *Attorney, Agent, or Firm* — Sughrue Mion, PLLC

(57) ABSTRACT

An inkjet recording apparatus includes: an inkjet head that ejects a liquid functional material toward a recording medium based on image signals; a recording medium conveying unit that conveys the recording medium to a position opposing the inkjet head; a supply path that supplies the liquid functional material to the inkjet head; a reservoir that communicates the supply path, and that reserves the liquid functional material; and a degassing mechanism that is provided in one of the inkjet head, the supply path and the reservoir, and that includes a degassing device and a vacuum pump, wherein the liquid functional material comprises compounds having minimum boiling point of approximately 110° C. or more, and the degassing vacuum degree of the degassing mechanism is approximately 0.06 atm or less.

11 Claims, 5 Drawing Sheets

| MINIMUM BOILING POINT | DEGASSING VACUUM DEGREE |
|---|---|
| 110°C | 0.06 ATM |
| 120°C | 0.04 ATM |
| 130°C | 0.03 ATM |
| 150°C | 0.02 ATM |
| 200°C | 0.01 ATM |

INKJET RECORDING APPARATUS

BACKGROUND OF THE INVENTION

1. Field of the Invention

The present invention relates to an inkjet apparatus of forming an image by ejecting a liquid functional material on a recording medium by an inkjet head.

2. Background Art

The inkjet apparatus of ejecting a liquid functional material (hereinafter referred to as an "ink") on a recording medium by using an inkjet head and thereby performing the image formation is characterized, for example, in that the system is environment-friendly, high-speed recording on various recording mediums can be realized, and a high-resolution image with less blurring can be obtained. Above all, development of an apparatus using an ultraviolet-curable ink is proceeding in view of easy handling of the light source, compactness and the like.

However, when an air bubble or dissolved gas is present in the inkjet ink, the ink cannot be satisfactorily compressed at the ejection and this gives rise to a problem of deterioration in the ejection property, incapability of generating stable ink drops, occurrence of dot missing or printing failure, or reduction in the reliability of the inkjet recording method.

For this reason, in the invention of JP-A-5-17712 (the term "JP-A" as used herein means an "unexamined published Japanese patent application") or JP-A-2004-196936, degassing of the inkjet ink is generally performed to remove the air bubble or dissolved gas.

FIG. 5 shows an inkjet recording apparatus previously developed by the present applicant based on the invention of Patent Document 1. In the Figure, 50 is an image recording part, 52 is a head unit, 58 is an inkjet head, 70 is an ink supply part, 72A and 72B are ink tanks, 74 is a pump equipped with a filter, 75 is a pipe as an air-feeding mechanism, 76 is a degassing (deoxygenating) device, 78 is a vacuum pump, 80 is an ink supply path, 80*a* is a guiding branch, 84 is an air-exposure valve, and L' is an aqueous ink (or a solvent ink).

This inkjet recording apparatus works as follows.

At the image formation, the air-exposure valve 84 is closed and the degassing mechanism 82 is simultaneously actuated to degas the aqueous ink L' in the ink supply path 80 and supply the ink to the inkjet head 58. The degassed aqueous ink L' is ejected from the inkjet head 58 based on the control of a head driver 54 and landed on a recording medium S (FIG. 1), and an ultraviolet ray is irradiated thereon from an ultraviolet irradiating part 56 (FIG. 1), whereby an image is formed.

The aqueous ink L' landed on the recording medium S is degassed and therefore, there is obtained an effect that the generation of a bubble in the inkjet head 58 is reduced and the ejection failure ascribable to the bubble is improved.

However, the ink used here is an aqueous ink or solvent ink and such an ink contains a component having a boiling point of about 100° C. In the case where the boiling point of the component is 100° C., boiling occurs when the pressure is reduced to about 0.1 atm at room temperature, and the occurrence of boiling is accompanied with alteration of the ink component. Therefore, degassing to a high vacuum of 0.1 atm or less (for example, 0.06 atm or less) is substantially impossible.

On the other hand, the gas component in the ink grows by rectified diffusion and particularly when the ejection is continuously performed for a long period of time, the conventional degassing to about 0.1 atm cannot stop growth of the bubble and allows for occurrence of an ejection failure and thus, this is insufficient. There has been no means effective for stably performing the inkjet ejection for a long period of time.

SUMMARY OF THE INVENTION

Under these circumstances, the present invention has been made to solve the problems above, and an object of the present invention is to provide a practicable inkjet recording apparatus ensuring that degassing can be effected satisfactorily and inkjet ejection can be stably performed for a long period of time.

(1) An inkjet recording apparatus includes: an inkjet head that ejects a liquid functional material toward a recording medium based on image signals; a recording medium conveying unit that conveys the recording medium to a position opposing the inkjet head; a supply path that supplies the liquid functional material to the inkjet head; a reservoir that communicates the supply path, and that reserves the liquid functional material; and a degassing mechanism that is provided in one of the inkjet head, the supply path and the reservoir, and that includes a degassing device and a vacuum pump, wherein the liquid functional material comprises compounds having minimum boiling point of approximately 110° C. or more, and the degassing vacuum degree of the degassing mechanism is approximately 0.06 atm or less.

(2) The inkjet recording apparatus as described in the item (1), wherein the minimum boiling point of the compounds is approximately 110° C., and the degassing vacuum degree of the degassing mechanism is approximately 0.06 atm.

(3) The inkjet recording apparatus as described in item (1), wherein the minimum boiling point of the compounds is approximately 120° C., and the degassing vacuum degree of the degassing mechanism is approximately 0.04 atm.

(4) The inkjet recording apparatus as described in the item (1), wherein the minimum boiling point of the compounds is approximately 130° C., and the degassing vacuum degree of the degassing mechanism is approximately 0.03 atm.

(5) The inkjet recording apparatus as described in item (1), wherein the minimum boiling point of the compounds is approximately 150° C., and the degassing vacuum degree of the degassing mechanism is approximately 0.02 atm.

(6) The inkjet recording apparatus as described in item (1), wherein the minimum boiling point of the compounds is approximately 200° C., and the degassing vacuum degree of the degassing mechanism is approximately 0.01 atm.

(7) The inkjet recording apparatus as described in any one of items (1) to (6), further includes: a control interface that includes a table showing a relationship between the minimum boiling point and the degassing vacuum degree; a pressure controller that controls a degassing vacuum degree of the degassing mechanism; and a vacuum gauge that measures the degassing vacuum degree of the degassing mechanism, wherein the control interface compares a value measured by the vacuum gauge with a target value, decides the target value based on the minimum boiling point, which is shown in the table, of the compounds of the liquid functional material, and controls the pressure controller to make coincident the value measured by the vacuum gauge with the target value.

(8) The inkjet recording apparatus as described in any one of the items (1) to (7), wherein the degassing vacuum degree of the degassing mechanism is determined by performing a proportional distribution based on a gradient of line connecting respective degassing vacuum degrees at nearest minimum boiling points above and below the minimum boiling point of the compound as determining object.

(9) The inkjet recording apparatus as described in any one of the items (1) to (8), wherein the liquid functional material comprises an ultraviolet-curable material.

As described above, a functional material comprising a high boiling point substance is used as the ink, so that degassing can be performed in a high vacuum not to allow the growth of a bubble and an inkjet apparatus causing no ejection failure and enabling to stably draw a good-quality image for a long period of time can be obtained.

BRIEF DESCRIPTION OF THE DRAWINGS

The invention disclosed herein will be understood better with reference to the following drawings of which.

DETAILED DESCRIPTION OF THE INVENTION

Figure 1:
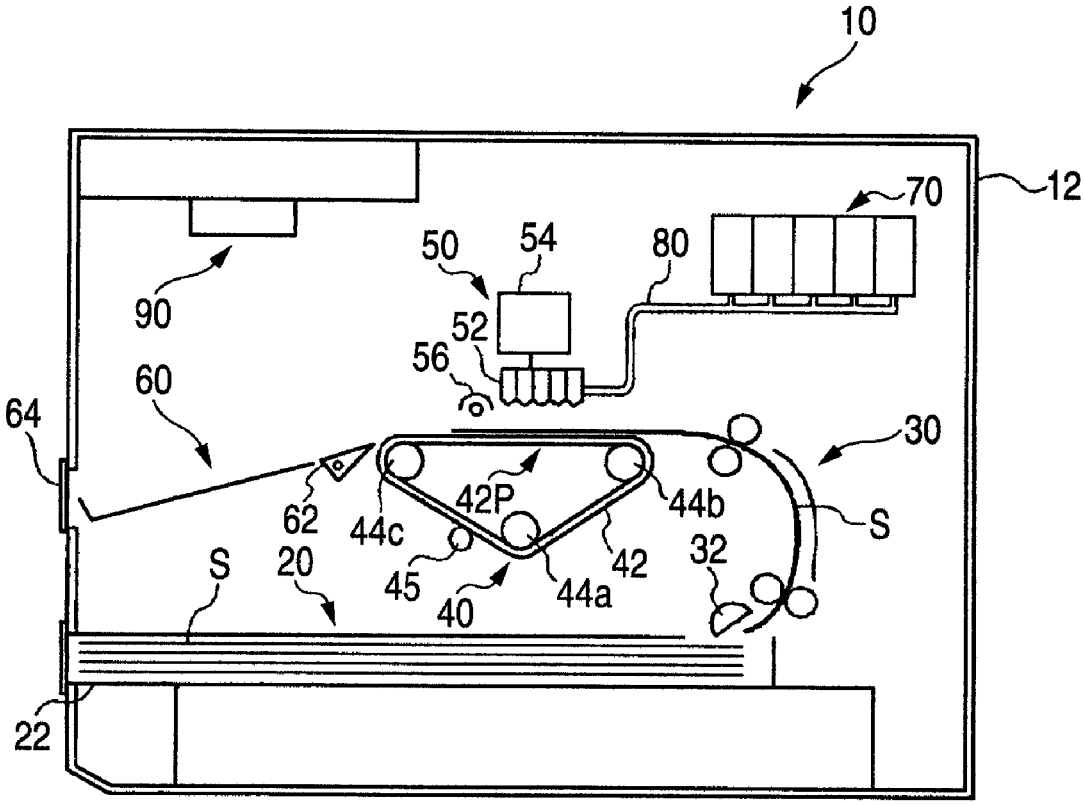
FIG. 1 is a construction view of an active energy curing-type inkjet recording apparatus.

The present invention is described in detail below by referring to the drawings.

Here, embodiments using an active energy-curable ink in which the minimum boiling point of the compounds constituting the composition is 110° C. or more are described, but the present invention is of course not limited to an active energy curing-type inkjet recording apparatus and as long as the ink comprises a high boiling point substance where the minimum boiling point of the compounds constituting the composition is 110° C. or more, any ink may be used.

Embodiment 1

Figure 2:
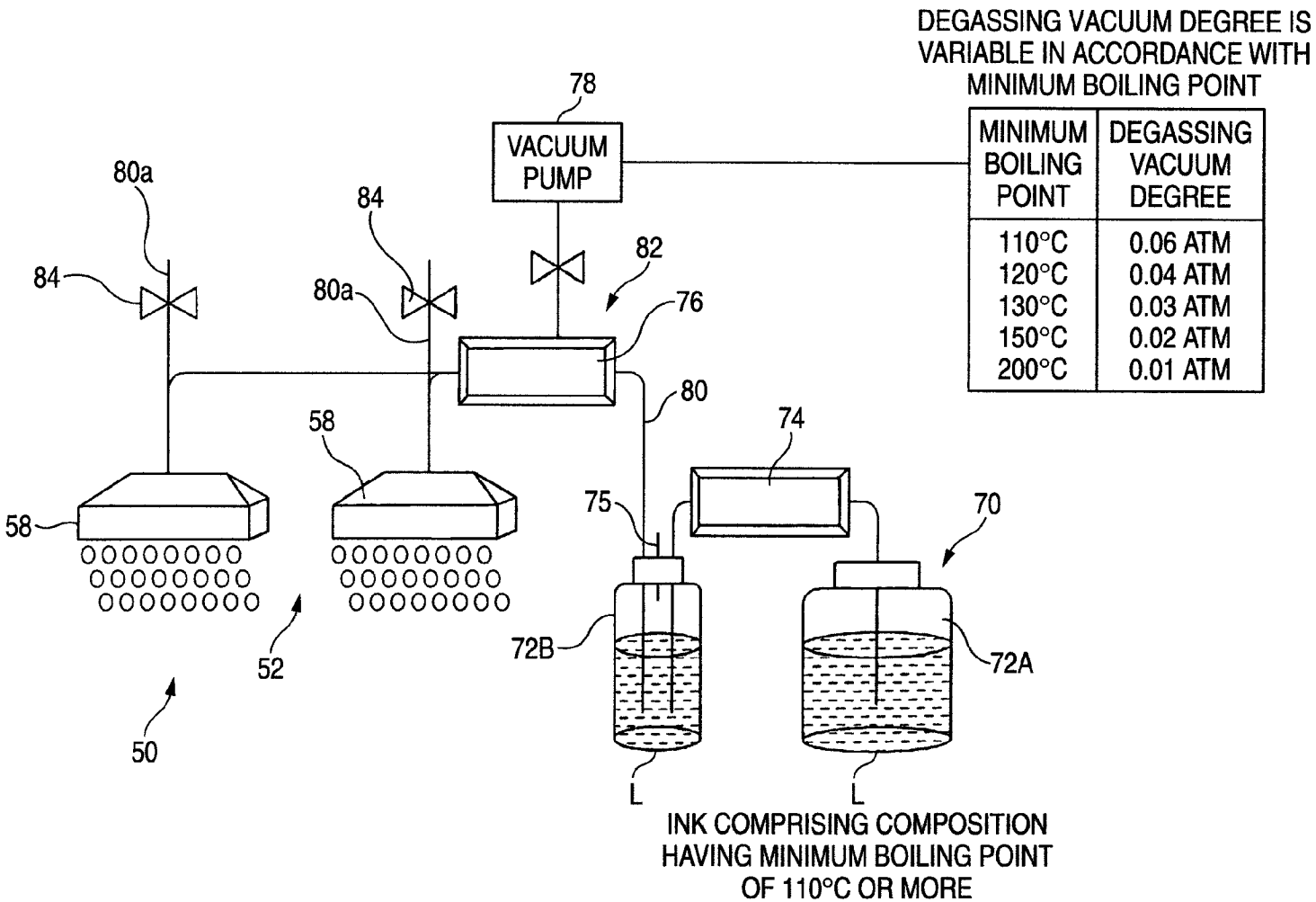
FIG. 2 is a schematic construction view showing the image recording part and the liquid functional material supply part in Embodiment 1 of the active energy curing-type inkjet recording apparatus shown in FIG. 1.

FIG. 1 is a construction view of an active energy curing-type inkjet recording apparatus as an objective of the present invention, and FIG. 2 is a schematic construction view showing the image recording part and the liquid functional material supply part (hereinafter sometimes referred to as an "ink supply part") of the active energy curing-type inkjet recording apparatus shown in FIG. 1.

The construction of the active energy curing-type inkjet recording apparatus is described below.

In FIG. 1, in a casing 12 of the active energy curing-type inkjet recording apparatus 10, there are provided a recording medium housing part 20 in which sheet-like recording mediums S in the same size are stored by piling a plurality of sheets in the inner lower part of the casing 12, a conveying part 30 in which the recording medium S taken out from the housing part 20 is conveyed to the upper position of the housing part 20, a scan-conveying part 40 which is disposed at the upper position of the housing part 20 and in which the recording medium S carried in from the conveying part 30 is conveyed under a held state in the recording position range, an image recording part 50 in which inkjet image recording scan and ultraviolet irradiation fixing (in this embodiment, ultraviolet light is used, but the light may be sufficient if it is an active energy) are applied to the recording medium S being conveyed under a held state by the scan-conveying part 40, a tray 60 in which the recording medium S recorded in the image recording part 50 is discharged, an ink supply part 70 which is a liquid functional material supply part connected for supplying a liquid functional material (hereinafter, sometimes referred to an "ink") to the image recording part 50, and an exhaust part 90 in which ventilation inside the apparatus is performed.

In the recording medium housing part 20, a housing cassette 22 for housing the recording medium S is removably disposed in the lower part of the casing 12 of the active energy curing-type inkjet recording apparatus 10, and a recording medium S in a different size can be supplied by changing the cassette. The recording medium housing part 20 may be constructed to load a plurality of cassettes.

In another construction of the recording medium housing part 20, a cassette may be designed to supply a rolled recording material. In this case, in place of the feed roller 32 in the conveying part 30, a cutter for cutting the recording material to a desired length may be disposed.

The scan-conveying part 40 comprises a conveying belt 42 which is driven in a stretched state over three belt rollers 44*a*, 44*b* and 44*c*. The conveying belt is driven from the upstream belt roller 44*b* to the downstream belt roller 44*c* direction, and the recording medium S is placed and conveyed on the conveying belt 42 between the upstream belt roller 44*b* and the downstream belt roller 44*c*. The image recording position 42P is set at the nearly mid-position between the upstream belt roller 44*b* and the downstream belt roller 44*c*.

Other than the belt conveyance, a construction such as conveyance on a platen or nip conveyance by rollers may also be employed.

In the image recording part 50, a head unit 52 is equipped by opposing its ink ejection end to the conveying belt 42 at the image recording position 42P. The head unit 52 used in this embodiment is a full-line type head having ejection nozzles over the entire region in the width direction of the recording medium S. A head driver 54 is connected to the head unit 52 and controls the ejection amount of the ink in each color. The ink supply part 70 may be constructed to allow for removable installation of the ink cartridge. Also, a coating mechanism other than inkjet or a surface treating mechanism may be provided before or after the image recording part 50.

Immediately after the image recording position 42P, an ultraviolet irradiating part 56 is disposed downstream of the head unit 52 and gives an energy high enough to cure and fix the ink immediately after landing on the recording medium S. In FIG. 1, only one ultraviolet irradiating part 56 is provided for a plurality of head units 52, but an arbitrary number of a plurality of head units 52 may also be equipped. At this time, the ultraviolet irradiating parts may differ in the kind, light quantity or spectrum.

A separation claw 62 is disposed downstream of the position where the recording medium S is separated from the conveying belt 42 (in this embodiment, at the position of the downstream belt roller 44*c*), and the distal end of the separation claw 62 promotes the separation of the recording medium S from the conveying belt 42 in the vicinity of the downstream belt roller 44*c*. The tray 60 houses the recording medium S separated from the conveying belt 42. This tray 60 is drawably equipped at the tray inlet/outlet 12*b* from the casing 12, and the tray inlet/outlet 12*b* has a lid 64.

The constructions of the liquid functional material supply part and the image recording part are described in detail below.

As shown in FIG. 2, the liquid functional material supply part 70 comprises ink tanks 72A and 72B for reserving an ink L which is the liquid functional material where the minimum boiling point of the compounds constituting the composition is 110° C. or more. The ink tanks 72A and 72B are connected through a pump 74 equipped with a filter, and the ink L reserved in the ink tank 72A is supplied to the ink tank 72B as needed. The ink tank 72B on the downstream side is communicated with the outside by a pipe 75 which is an air-feeding mechanism. In the air-feeding mechanism, the pipe 75 may be equipped with an air pump to forcedly supply an air to the ink tank 72B. The ink tank preferably has a stirring mechanism.

As for the pump 74, various pumps such as roller pump, gear pump, piston pump, diaphragm pump and rotary pump may be used. However, the pump must be continuously operated under a pressure of 0.04 atm or less. For example, DTU-20 manufactured by Ulvac Kiko, Inc. may be used, and the pump is preferably capable of coping with a solvent. In the periphery of the pump, a trap, a manometer and a controller can be disposed, if desired.

The ink tank 72 and the inkjet head 58 of the head unit 52 are connected through an ink supply path 80 which is the liquid functional material path, and the ink L is supplied from the ink tank 72 to the inkjet head 58. In the midway of the ink supply path 80, a degassing mechanism comprising a degassing device 76 and a vacuum pump 78 is provided.

The degassing device 76 employs a degassing membrane system of removing a gas dissolved in the ink to the vacuum side through a membrane. That is, this is a method of flowing a liquid to one side of a gas-permeable/liquid-impermeable diaphragm and depressurizing the other side, thereby removing a gas dissolved in the liquid to the vacuum side through the membrane. More specifically, gas-permeable/liquid-impermeable hollow yarn membranes such as polytetrafluoroethylene are bundled, the periphery of the hollow yarn is made pressure-reduced by the vacuum pump 78 and when the ink L from the ink tank is sent to the degassing device 76, the dissolved gas is removed from the ink L through the gas-permeable membrane.

As for the deoxygenation/dehydration, in addition to the membrane deoxygenation/dehydration or tube deoxygenation/dehydration, ultrasonic vibration may be imparted by an ultrasonic oscillator, if desired. Also, a filter may be disposed before or after the degassing device 76.

As for the degassing vacuum degree achieved by operating the degassing device 76, a higher vacuum degree produces more improvement of the degassing and is preferred, but since an ink where the minimum boiling point of the compounds constituting the composition is 110° C. or more is used, it is effective to determine the degassing vacuum degree in this relation.

The degassing vacuum degree is determined from the minimum boiling point of the compounds constituting the composition by using the Antoine equation, the pressure-temperature nomograph or the like. It is effective and preferred that the degassing vacuum degree is 0.06 atm when the minimum boiling point is 110° C., the degassing vacuum degree is 0.04 atm when the minimum boiling point is 120° C., the degassing vacuum degree is 0.03 atm when the minimum boiling point is 130° C., the degassing vacuum degree is 0.02 atm when the minimum boiling point is 150° C., and the degassing vacuum degree is 0.01 atm or less when the minimum boiling point is 200° C. or more.

When the minimum boiling point is not included in the numerical values above, the degassing vacuum degree can be determined by a known interpolation method, for example, by performing proportional distribution based on the gradient connecting respective degassing vacuum degrees at known nearest minimum boiling points above and below the minimum boiling point.

The degassing vacuum degree is adjusted by the user by directly controlling the vacuum pump (or a pressure controller provided on the degassing line).

Incidentally, trace composition, impurity, dissolved gas and water of 5% or less are excluded in determining the minimum boiling point of the compounds constituting the ink composition.

In general, when a high boiling point ink is used, the drying/fixing process becomes difficult. Therefore, the ink is preferably the active energy ray-curable ink used here.

The ink supply path 80 has a guiding branch 80*a* branched in the vicinity of the inkjet head 58, and one end of the guiding branch 80*a* communicates with the outside through an air-exposure valve 84 connected to the guiding branch 80*a*. The outside may be atmospheric air but is preferably a back pressure adjusting mechanism.

As for the material of the ink supply path 80 and the guiding branch 80*a*, a metal tube such as SUS tube or copper tube, a PTFE, PFA, FEP or perfluoro tube, or a multilayer tube having a fluorine compound on the inner surface (for example, PASCAL tube produced by Mitsuboshi Co., Ltd.) is preferably used. A layer having high gas-barrier property (for example, EVOH) is preferably used for one of the exteriors. Depending on the case, a material having a light-shielding function is preferred.

The degassing effect can be determined by measuring the dissolved oxygen amount.

The dissolved oxygen amount can be measured using, for example, DO-24P or DO-32A manufactured by DKK-TOA Corp. However, in the case of use for an ink other than an aqueous ink, an electrode capable of coping with an organic solvent must be used. Also, when an organic solvent is used, the absolute amount of the dissolved oxygen amount cannot be measured and therefore, the degassing effect needs to be evaluated by a relative dissolved oxygen amount assuming that the saturation dissolved oxygen amount of each ink is 100%. In the case of using the construction above, the dissolved oxygen amount is 5% or less and becomes 1% or less when an optimal construction is established.

The mode of operation of this embodiment is described below.

The minimum boiling point information of the compounds constituting the composition contained in the ink L used is obtained before performing the image formation and the vacuum pump 78 is set to give a degassing vacuum degree corresponding to the minimum boiling point. The degassing vacuum degree corresponding to the minimum boiling point is determined as described above.

As a result thereof, by setting the degassing vacuum degree to 0.06 atm when the minimum boiling point of the compounds constituting the ink composition is 110° C., to 0.04 atm when 120° C., to 0.03 atm when 130° C., to 0.02 atm when 150° C., and to 0.01 atm when 200° C., a high vacuum degree just enough to allow for no boiling of the ink can be realized and an air bubble or dissolved gas in the ink can be most efficiently degassed, so that a stable ink particle can be obtained and in turn, highly reliable inkjet recording free from occurrence of dot missing or printing failure can be performed.

Accordingly, at the image formation, the air-exposure valve 84 is closed and at the same time, the degassing mechanism (degassing device 76, vacuum pump 78) are operated, whereby the ink L in the ink supply path 80 is most efficiently degassed and then supplied to the inkjet head 58. The effectively degassed ink L is ejected from the inkjet head 58 based on the control of the head driver 54, landed on the recording medium S and irradiated with an ultraviolet ray from the ultraviolet irradiating part 56 to form an image.

Since the ink L landed on the recording medium S has been efficiently degassed, a bubble is not generated in the inkjet head 58 and ejection failure ascribable to a bubble is improved. As for the vacuum degree at the degassing, the vacuum pump 78 is controlled to give an optimal vacuum degree according to the minimum boiling point of the compounds constituting the composition in the ink L, so that the ink can be free from boiling and at the same time, effective degassing can be performed.

After an image is formed, in the case of not performing next image formation for a long time, that is, when the image formation is stopped, the ink L is supplied from the ink tank 72 to the inkjet head 58 in the state of the degassing mechanism 82 being halted, and the ink supply path 80 and the inside of the inkjet head 58 are filled with a non-degassed ink L, in other words, an ink L containing a curing inhibitor (oxygen), whereby the ink L is prevented from curing at the stoppage of the active energy curing-type inkjet recording apparatus 10.

According to the active energy curing-type inkjet recording apparatus 10 of this embodiment, a degassing mechanism which is disposed in the liquid functional material supply part 70 or the image recording part 50 and effects degassing from the liquid functional material (ink) L at the image formation in the image recording part 50 is provided, so that a high-quality image can be obtained by forming an image using a liquid functional material L from which the curing inhibitor oxygen is removed and curing the active energy-curable ink L in a short time. Furthermore, the liquid functional material L is exposed to air at the stoppage of image formation, so that the liquid functional material L can be allowed to absorb oxygen in air and stably stored over a long period of time by suppressing the progress of curing.

Also, means for switching between the degassing mechanism 82 and the mechanism of exposing the liquid functional material L to air is provided, so that the deoxygenation mode by the degassing mechanism and the air exposure mode can be switched by a simple operation at the image formation or at the stoppage of image formation.

The liquid functional material supply part 70 has an air-feeding mechanism 75 capable of introducing air into the liquid functional material tank 72, so that the liquid functional material L stored in the liquid functional material tank 72 can be made to absorb water by aggressively introducing air.

An air-exposure valve 84 capable of exposing the liquid functional material L to air is disposed upstream of the inkjet head 58, so that at the image formation, the liquid functional material path 80 running from the air-exposure valve 84 to the inkjet head 58 can be filled with the liquid functional material L to block out air by closing the air-exposure valve 84, whereas at the stoppage of image formation, the liquid functional material L can be exposed to air by opening the air-exposure valve 84 and the liquid functional material L can be made to absorb the curing inhibitor oxygen from air.

In this way, according to Embodiment 1 of the present invention, the air in the ink can be satisfactorily degassed and therefore, a practicable inkjet recording apparatus assured of stable inkjet ejection for a long time can be obtained.

Embodiment 2

Figure 3:
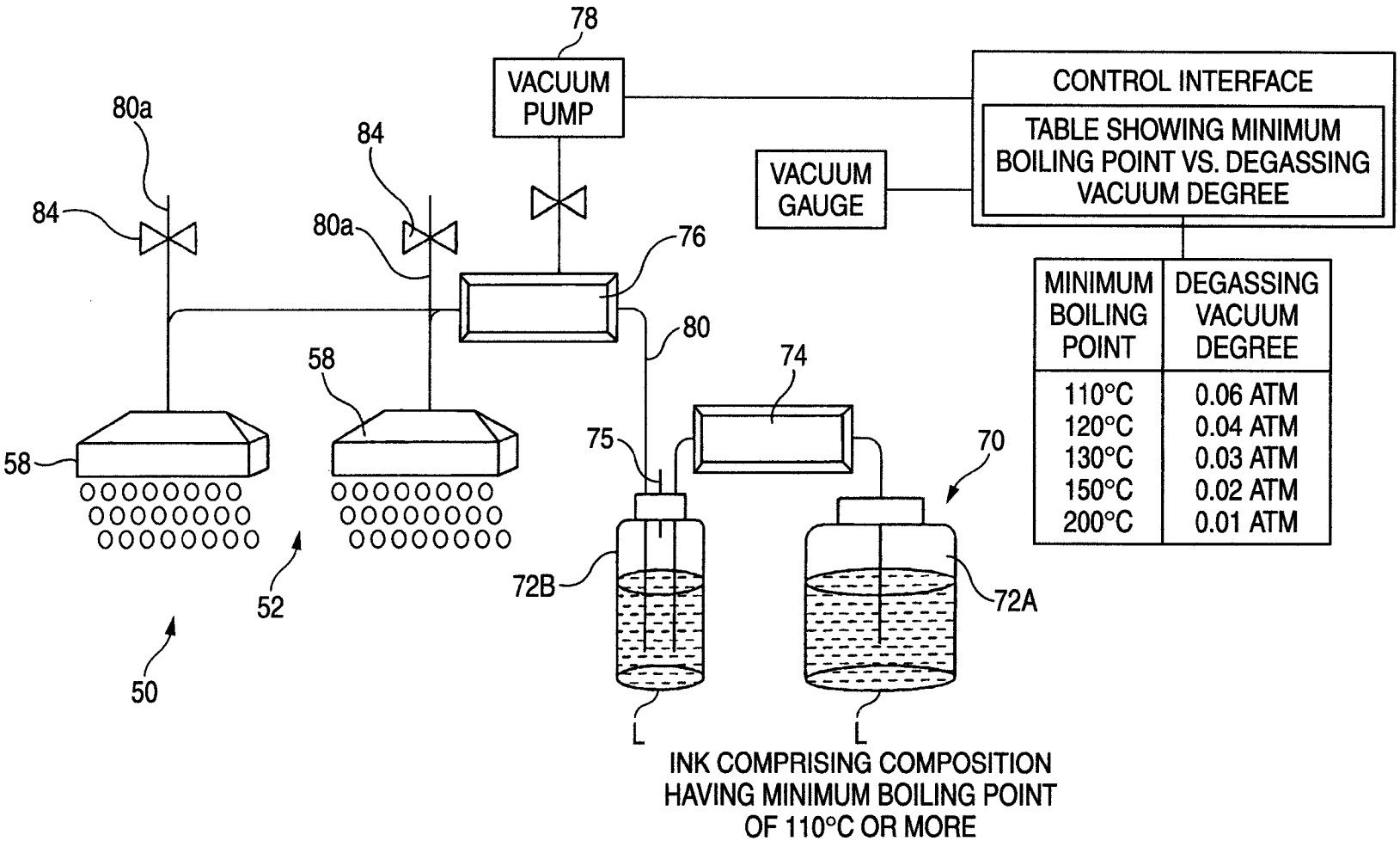
FIG. 3 is a schematic construction view showing the image recording part and the liquid functional material supply part in Embodiment 2 of the active energy curing-type inkjet recording apparatus shown in FIG. 1.

FIG. 3 is a view showing Embodiment 2 of the present invention and the members already shown in FIG. 2 are indicated using the same reference characters as in FIG. 2 by omitting repeated description thereof here. In FIG. 3, a control interface (PC) is used and equipped with a table showing the relationship of the minimum boiling point vs. the degassing vacuum degree. The table showing the relationship of the minimum boiling point vs. the degassing vacuum degree is a table indicating that the degassing vacuum degree is 0.06 atm when the minimum boiling point of the compounds constituting the ink composition is 110° C., 0.04 atm when 120° C., 0.03 atm when 130° C., 0.02 atm when 150° C., and 0.01 atm when 200° C. When the minimum boiling point is not included in the numerical values above, a degassing vacuum degree interpolated based on the nearest minimum boiling points above and below the unincluded minimum boiling point is used. Only by thus inputting the minimum boiling point of the compounds constituting the composition of the liquid functional material, the control interface automatically decides the target value of the vacuum degree based on the table and at the same time, control the pressure-control valve to give the target vacuum degree.

Also, a vacuum gauge for measuring the vacuum degree of the degassing device is equipped. The vacuum gauge must respond to the vacuum degree of approximately from 0.001 to 1 atm. Examples of the vacuum gauge include a crystal vacuum gauge, M-320XG, manufactured by Canon ANELVA Corp.

The measured value of the vacuum gauge is sent to the control interface. The control interface after receiving the measured value of the vacuum gage compares the measured value with the target value and controls the vacuum pump to make coincident the measured value with the target value.

Figure 4:
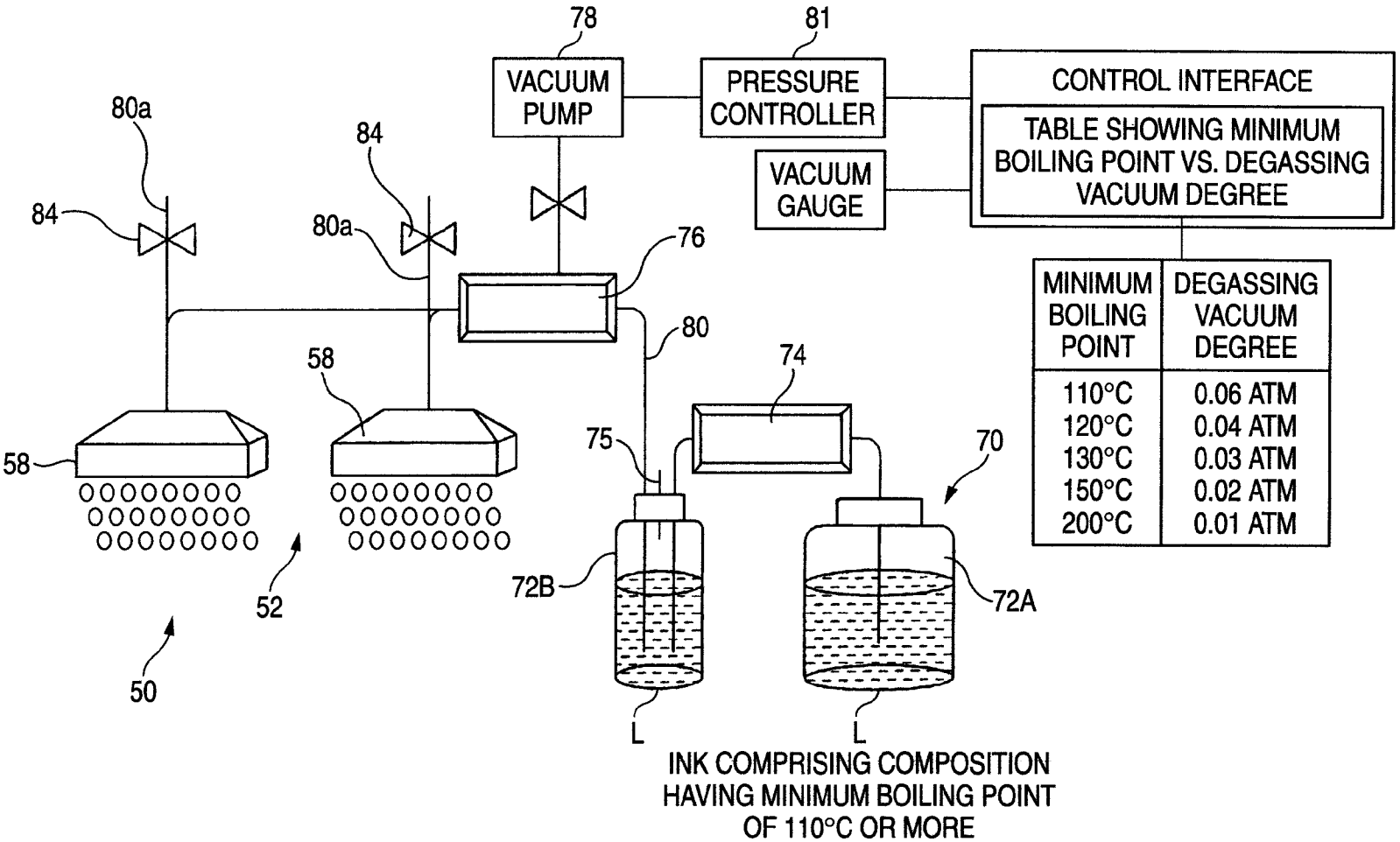
FIG. 4 is a schematic construction view showing the image recording part; and the liquid functional material supply part in a modified example of Embodiment 2 of the active energy curing-type inkjet recording apparatus shown in FIG. 1.
Figure 5:
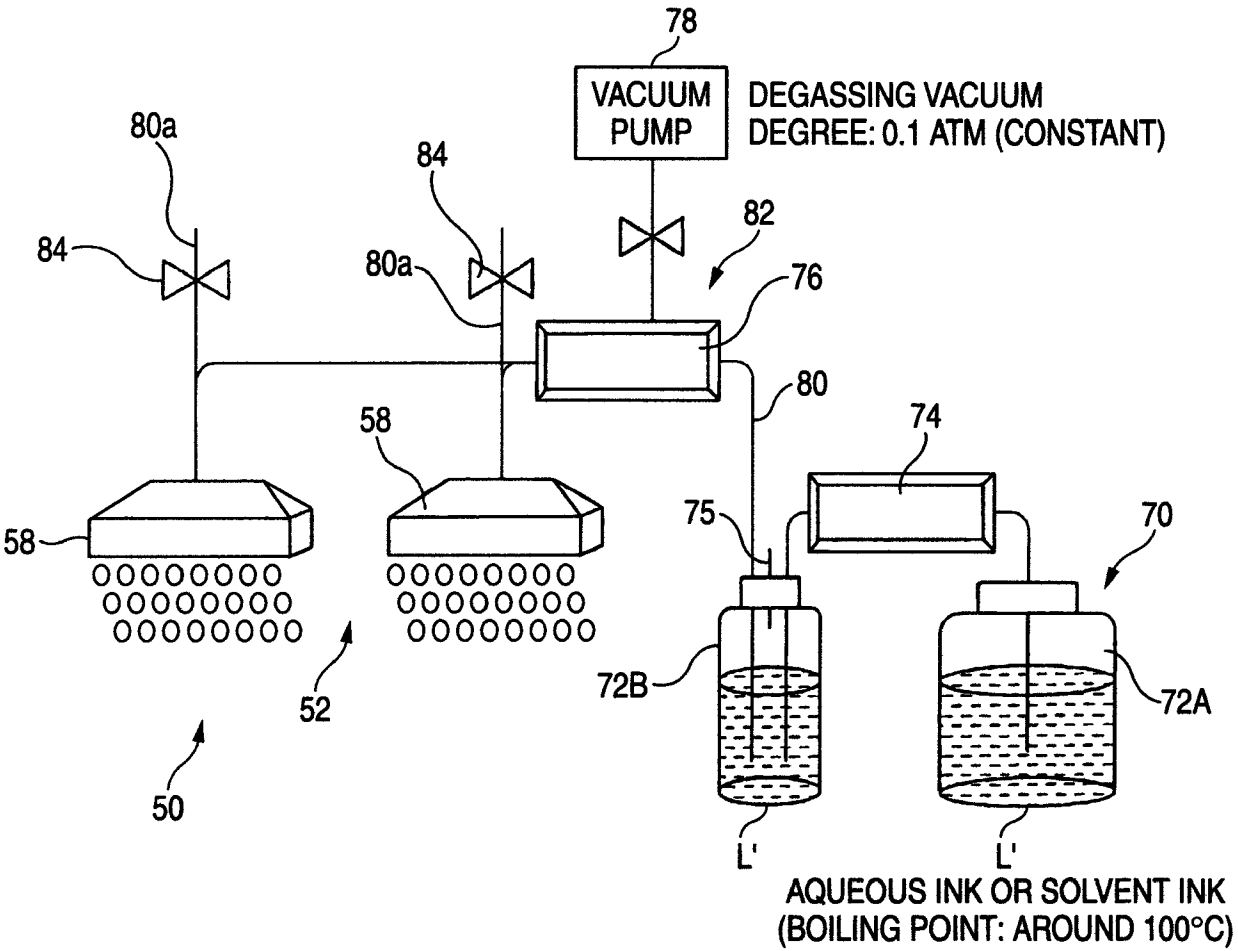
FIG. 5 is a schematic construction view showing the image recording part and the liquid functional material supply part of the active energy curing-type inkjet recording apparatus as a prior invention of the present invention.

In addition, a pressure controller 81 may be controlled by the control interface and provided on the degassing line as shown in FIG. 4. The pressure controller 81 may be directly connected with the vacuum pump 78.

In this way, as for the reference parameter of the functional material when adjusting the degassing vacuum degree, the minimum boiling point of the compounds mainly constituting the composition contained is preferably used. The calculation of the degassing vacuum degree from the boiling point is preferably performed using the Antoine equation or the pressure-temperature nomograph.

In the case of adjusting the degassing vacuum degree according to the boiling point, the degassing vacuum degree is adjusted by the vacuum pump or the pressure controller provided on the degassing line. In Embodiment 1, the degassing vacuum degree is adjusted by the user by directly controlling the controller, but in Embodiment 2, the vacuum degree is automatically controlled by the control interface.

In this way, according to Embodiment 2 of the present invention, only by inputting into PC the minimum boiling point of the compounds constituting the ink composition used, satisfactory degassing of air in the ink can be automatically performed, so that a practicable inkjet recording apparatus assured of stable inkjet ejection for a long time can be obtained.

Incidentally, as an unexpected effect of the present invention, ejection failure ascribable to drying of the ink can also be reduced. Furthermore, in the case of a UV-curable ink, the curing property is enhanced.

Here, Examples 1 to 3 are described, where the continuously image drawable time is examined for every degassing vacuum degrees with respect to various inks having a high boiling point.

(Preparation of Cyan Pigment Dispersion)

PB 15:3 (IRGALITE BLUE GLO, produced by Ciba Specialty Chemicals Corp.) (160 g), 480 g of dipropylene glycol diacrylate (DPGDA, produced by DAICEL-CYTEC Company Ltd.) and 160 g of Solsperse 32000 (produced by Zeneca) were mixed and stirred with a stirrer for 1 hour. The mixture after stirring was dispersed in an Eiger mill to obtain Pigment Dispersion P-1.

As for the dispersion conditions, zirconia beads having a diameter of 0.65 mm were packed at a filling factor of 70%, the peripheral velocity was 9 m/s and the dispersion time was 1 hour.

(Preparation of Ink I-1)

The components in the following composition were mixed under stirring and dissolved to prepare Inks I-1 to I-4.

I-1: for Comparative Example 1 (Containing Light Ester M Having a Boiling Point of 100° C.)

| | |
|---|---|
| Pigment Dispersion P-1 | 21.6 g |
| Light Ester M (produced by Kyoeisha Chemical Co., Ltd.) | 5 g |
| Dipropylene glycol diacrylate (polymerizable compound) (DPGDA, produced by DAICEL-CYTEC Company Ltd.) | 93.4 g |
| Polymerization initiator Irg907 shown below (produced by Ciba Specialty Chemicals Corp.) | 15 g |
| Sensitizer Darocure ITX shown below (produced by Ciba Specialty Chemicals Corp.) | 7.5 g |
| Sensitizer Darocure EDB shown below (produced by Ciba Specialty Chemicals Corp.) | 7.5 g |

I-2: for Example 1 (Containing Toluene Having a Boiling Point of 110° C. as the Solvent for Dissolution)

| | |
|---|---|
| Pigment Dispersion P-1 | 21.6 g |
| Toluene (produced by Aldrich K.K.) | 5 g |
| Dowanol TPM (produced by Dow Chemical Corp.) | 93.4 g |

I-3: for Example 2 (Containing Cyclopentanone Having a Boiling Point of 130° C.)

| | |
|---|---|
| Pigment Dispersion P-1 | 21.6 g |
| Cyclopentanone (produced by Aldrich K.K.) | 5 g |
| Dipropylene glycol diacrylate (polymerizable compound) (DPGDA, produced by DAICEL-CYTEC Company Ltd.) | 93.4 g |
| Polymerization initiator Irg907 shown below (produced by Ciba Specialty Chemicals Corp.) | 15 g |

-continued

| | |
|---|---|
| Sensitizer Darocure ITX shown below (produced by Ciba Specialty Chemicals Corp.) | 7.5 g |
| Sensitizer Darocure EDB shown below (produced by Ciba Specialty Chemicals Corp.) | 7.5 g |

I-4: for Example 3

| | |
|---|---|
| Pigment Dispersion P-1 | 21.6 g |
| Dipropylene glycol diacrylate (polymerizable compound) (DPGDA, produced by DAICEL-CYTEC Company Ltd.) | 98.4 g |
| Polymerization initiator Irg907 shown below (produced by Ciba Specialty Chemicals Corp.) | 15 g |
| Sensitizer Darocure ITX shown below (produced by Ciba Specialty Chemicals Corp.) | 7.5 g |
| Sensitizer Darocure EDB shown below (produced by Ciba Specialty Chemicals Corp.) | 7.5 g |

Irg907:

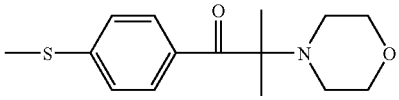

Darocure ITX:

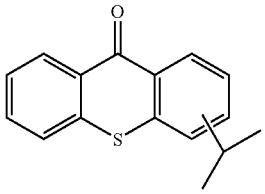

Darocure EDB:

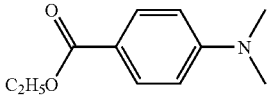

The continuously image drawable time for every degassing vacuum degrees of each ink is shown in Table 1.

The "continuously image drawable time" in Table 1 is the time until an ejection failure was generated when a head, CA3, produced by Toshiba TEC Corporation was continuously driven for ink ejection.

TABLE 1

| | Ink | Minimum Boiling Point Component | Boiling Point (° C.) | Continuously Image Drawable Time (hour) for Every Degassing Vacuum Degrees | | | |
|---|---|---|---|---|---|---|---|
| | | | | 0.1 atm | 0.06 atm | 0.03 atm | 0.008 atm |
| Comparative Example 1 | I-1 | Light Ester M | 100° C. | 1.4 | 0.2 | <0.1 | <0.1 |
| Example 1 | I-2 | toluene | 110° C. | 1.7 | 3.6 | 2.4 | 1.2 |
| Example 2 | I-3 | cyclopentanone | 130° C. | 1.5 | 3.4 | 7.8 | 5.8 |
| Example 3 | I-4 | DGPDA | >150° C. | 1.6 | 3.5 | 7.5 | >8 |

As seen from Table 1, fundamentally, the continuously image drawable time is longer as the degassing vacuum degree is higher (the degassing pressure is lower), but when the degassing vacuum degree reaches a certain value or more, the continuously image drawable time tends to decrease, revealing that the upper limit of the vacuum degree depends on the boiling point of the minimum boiling point component.

In Comparative Example I-1, when the degassing vacuum degree is made to be 0.1 atm or less, the continuously image drawable time decreases. This is considered because Light Ester M evaporates due to high vacuum and change in the ink state is caused.

On the other hand, in Examples 1 to 3, the vacuum degree can be increased in accordance to the boiling point of the minimum boiling point component and at a boiling point>150° C., the image can be drawn for 8 hours or more.

The upper limit of the vacuum degree at each boiling point can be set using, for example, the pressure-temperature nomograph described in the catalogue of Aldrich K.K.

At this time, the upper limit of the vacuum degree at room temperature of 25° C. is as follows.

Boiling point of 100° C.: 0.08 atm
Boiling point of 110° C.: 0.05 atm
Boiling point of 120° C.: 0.04 atm
Boiling point of 130° C.: 0.02 atm
Boiling point of 140° C.: 0.015 atm
Boiling point of 150° C.: 0.008 atm The "active energy" as used in the present invention is not particularly limited as long as its irradiation can impart energy capable of generating an initiation species in the ink composition, and widely includes α-ray, γ-ray, X-ray, ultraviolet ray, visible ray, electron beam and the like. Among these, in view of curing sensitivity and easy availability of the apparatus, ultraviolet ray and electron beam are preferred, and ultraviolet ray is more preferred. Accordingly, the ink composition for use in the present invention is preferably an ink composition which can be cured by the irradiation of ultraviolet ray.

In the inkjet recording apparatus of the present invention, the peak wavelength of active energy varies depending on the absorption characteristics of the sensitizing dye in the ink composition but is suitably, for example, from 200 to 600 nm, preferably from 300 to 450 nm, more preferably from 350 to 450 nm. Also, the (a) electron transfer-type initiation system of the ink composition for use in the present invention exhibits sufficiently high sensitivity even for low-output active energy. Accordingly, the output of the active energy used as the irradiation energy is suitably, for example, 2,000 mJ/cm$^2$ or less, preferably from 10 to 2,000 mJ/cm$^2$, more preferably from 20 to 1,000 mJ/cm$^2$, still more preferably from 50 to 800 mJ/cm$^2$. Also, the active energy is suitably irradiated at an exposure surface illuminance (a maximum illuminance on the recording medium surface) of, for example, from 10 to 2,000 mW/cm$^2$, preferably from 20 to 1,000 mW/cm$^2$.

Particularly, in the inkjet recording apparatus of the present invention, the active energy is preferably irradiated from a light-emitting diode which can generate an ultraviolet ray having an emission wavelength peak of 390 to 420 nm and giving a maximum illuminance of 10 to 1,000 mW/cm$^2$ on the recording medium surface.

Also, in the inkjet recording apparatus of the present invention, the active energy suitably irradiates the ink composition ejected on a recording medium, for example, for 0.01 to 120 seconds, preferably from 0.1 to 90 seconds.

Furthermore, in the inkjet recording apparatus of the present invention, it is preferred that the ink composition is heated to a fixed temperature and the time from the landing of ink composition on a recording medium to the irradiation of active energy is set to 0.01 to 0.5 seconds, preferably from 0.02 to 0.3 seconds, more preferably from 0.03 to 0.15 seconds. By virtue of controlling the time from the landing of ink composition on a recording medium to the irradiation of active energy to such a very short time, the ink composition landed can be prevented from bleeding before curing.

For obtaining a color image by using the inkjet recording apparatus of the present invention, the colors are preferably superposed in the color value order from lower to higher. When superposed in such an order, the active energy can readily reach the ink in the lower part and this can be expected to yield good curing sensitivity, reduction of residual monomer, decrease of odor and enhancement of adhesive property. As for the irradiation of active energy, all colors may be ejected and en bloc exposed, but exposure is preferably performed every each color in view of accelerating the curing.

As described above, in the case of active energy-curable ink like the ink composition of the present invention, the ink composition ejected is preferably kept at a constant temperature and therefore, the temperature in the region from the ink supply tank to the inkjet head portion is preferably controlled by heat insulation and heating. Also, the head unit is preferably heated by thermally shielding or insulating the apparatus body so as not to receive an effect from the temperature of outer air. In order to shorten the printer start-up time necessary for heating or reduce the loss of heat energy, in combination with thermal insulation from other sites, the heat capacity of the entire heating unit is preferably made small.

As for the active energy source, a mercury lamp, a gas/solid laser and the like are principally utilized and for the ultraviolet curing-type inkjet, a mercury lamp and a metal halide lamp are widely known. Furthermore, replacement by a GaN-based semiconductor ultraviolet light-emitting device is industrially and environmentally very useful. In addition, LED (UV-LED) and LD (UV-LD) are compact, long-lived, highly efficient and low costing and are promising as a radiation source for active energy curing-type inkjet.

As described above, a light-emitting diode (LED) and a laser diode (LD) can be used as the active energy source. In particular, when an ultraviolet source is necessary, an ultraviolet LED or an ultraviolet LD can be used. For example, an ultraviolet LED of which main emission spectrum has a wavelength between 365 nm and 420 nm is commercially available from Nichia Corp. Also, when a further shorter wavelength is required, an LED capable of emitting active energy having a primary emission between 300 nm and 370 nm is disclosed in U.S. Pat. No. 6,084,250. Other ultraviolet LEDs are also available, and radiations in different ultraviolet bands may be irradiated. The active energy source for use in the present invention is preferably UV-LED, more preferably UV-LED having a peak wavelength in the region of 350 to 420 nm.

(Recording Medium)

The recording medium to which the ink composition of the present invention can be applied is not particularly limited and normal paper sheets such as non-coated paper and coated paper, and various non-absorptive resin materials and resin films shaped therefrom, which are used in so-called soft packaging, may be used. Examples of various plastic films include PET film, OPS film, OPP film, ONy film, PVC film, PE film and TAC film. Other examples of the plastic usable as the recording medium material include polycarbonate, acrylic resin, ABS, polyacetal, PVA and rubbers. Furthermore, metals and glasses may also be used as the recording medium.

In the ink composition of the present invention, when a material less causing heat shrinkage at curing is selected, excellent adhesive property is obtained between the cured ink composition and the recording medium and this is advantageous in that a high-definition image can be formed even on a film susceptible to curling or deformation due to, for example, curing shrinkage of ink or heat generation at the curing reaction, such as PET film, OPS film, OPP film, ONy film and PVC film which are thermally shrinkable.

The constituent components for use in the ink composition usable in the present invention are described below in sequence.

(Ink Composition)

The ink composition for use in the present invention is an ink composition capable of being cured by the irradiation of active energy, and examples thereof include a cationic polymerization-type ink composition, a radical polymerization-type ink composition and an aqueous ink composition. These compositions are described in detail below.

(Cationic Polymerization-Type Ink Composition)

The cationic polymerization-type ink composition contains (a) a cationic polymerizable compound and (b) a compound capable of generating an acid upon irradiation with active energy and if desired, may further contain a colorant, an ultraviolet absorbent, a sensitizer, an antioxidant, a discoloration inhibitor, electrically conducting salts, a solvent, a polymer compound, a surfactant and the like.

The constituent components used in the cationic polymerization-type ink composition are described below in sequence.

(a) (Cationic Polymerizable Compound)

The (a) cationic polymerizable compound for use in the present invention is not particularly limited as long as it is a compound capable of being cured by causing a polymerization reaction using an acid generated from the (b) compound capable of generating an acid upon irradiation with active energy, and various known cationic polymerizable monomers known as a photo-cationic polymerizable monomer may be used. Examples of the cationic polymerizable monomer include epoxy compounds, vinyl ether compounds and oxetane compounds described in JP-A-6-9714, JP-A-2001-31892, JP-A-2001-40068, JP-A-2001-55507, JP-A-2001-310938, JP-A-2001-310937 and JP-A-2001-220526.

Examples of the epoxy compound include an aromatic epoxide, an alicyclic epoxide and an aliphatic epoxide.

The aromatic epoxide includes a di- or polyglycidyl ether produced by the reaction of a polyhydric phenol having at least one aromatic nucleus or an alkylene oxide adduct thereof with epichlorohydrin. Examples thereof include a di- or polyglycidyl ether of bisphenol A or an alkylene oxide adduct thereof, a di- or polyglycidyl ether of hydrogenated bisphenol A or an alkylene oxide adduct thereof, and a novolak-type epoxy resin. Examples of the alkylene oxide include an ethylene oxide and a propylene oxide.

As for the alicyclic epoxide, a cyclohexene oxide- or cyclopentene oxide-containing compound obtained by epoxidizing a compound having at least one cycloalkene ring such as cyclohexene or cyclopentene ring with an appropriate oxidizing agent such as hydrogen peroxide and peracid is preferred.

Examples of the aliphatic epoxide include a di- or polyglycidyl ether of an aliphatic polyhydric alcohol or an alkylene oxide adduct thereof. Representative examples thereof include a diglycidyl ether of an alkylene glycol, such as diglycidyl ether of ethylene glycol, diglycidyl ether of propylene glycol, and diglycidyl ether of 1,6-hexanediol; a polyglycidyl ether of a polyhydric alcohol, such as di- or triglycidyl ether of glycerin or an alkylene oxide adduct thereof; and a diglycidyl ether of a polyalkylene glycol, as represented by a diglycidyl ether of a polyethylene glycol or an alkylene oxide adduct thereof, and a diglycidyl ether of a polypropylene glycol or an alkylene oxide adduct thereof. Here, examples of the alkylene oxide include an ethylene oxide and a propylene oxide.

The epoxy compound may be monofunctional or polyfunctional.

Examples of the monofunctional epoxy compound which can be used in the present invention include phenyl glycidyl ether, p-tert-butylphenyl glycidyl ether, butyl glycidyl ether, 2-ethylhexyl glycidyl ether, allyl glycidyl ether, 1,2-butylene oxide, 1,3-butadiene monoxide, 1,2-epoxydodecane, epichlorohydrin, 1,2-epoxydecane, styrene oxide, cyclohexene oxide, 3-methacryloyloxymethylcyclohexene oxide, 3-acryloyloxymethylcyclohexene oxide and 3-vinylcyclohexene oxide.

Examples of the polyfunctional epoxy compound include bisphenol A diglycidyl ether, bisphenol F diglycidyl ether, bisphenol S diglycidyl ether, brominated bisphenol A diglycidyl ether, brominated bisphenol F diglycidyl ether, brominated bisphenol S diglycidyl ether, epoxy novolak resin, hydrogenated bisphenol A diglycidyl ether, hydrogenated bisphenol F diglycidyl ether, hydrogenated bisphenol S diglycidyl ether, 3,4-epoxycyclohexylmethyl-3',4'-epoxycyclohexane carboxylate, 2-(3,4-epoxycyclohexyl-5,5-spiro-3,4-epoxy)cyclohexane-meta-dioxane, bis(3,4-epoxycyclohexylmethyl)adipate, vinylcyclohexene oxide, 4-vinylepoxycyclohexane, bis(3,4-epoxy-6-methylcyclohexylmethyl)adipate, 3,4-epoxy-6-methylcyclohexyl-3',4'-epoxy-6'-methylcyclohexane carboxylate, methylenebis(3,4-epoxycyclohexane), dicyclopentadiene diepoxide, di(3,4-epoxycyclohexylmethyl)ether of ethylene glycol, ethylenebis(3,4-epoxycyclohexane carboxylate), dioctyl epoxyhexahydrophthalate, di-2-ethylhexyl epoxyhexahydrophthalate, 1,4-butanediol diglycidyl ether, 1,6-hexanediol diglycidyl ether, glycerin triglycidyl ether, trimethylolpropane triglycidyl ether, polyethylene glycol diglycidyl ether, polypropylene glycol diglycidyl ethers, 1,1,3-tetradecadiene dioxide, limonene dioxide, 1,2,7,8-diepoxyoctane and 1,2,5,6-diepoxycyclooctane.

Among these epoxy compounds, an aromatic epoxide and an alicyclic epoxide are preferred in view of excellent curing rate, and an alicyclic epoxide is more preferred.

Examples of the vinyl ether compound include a di- or trivinyl ether compound such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and a monovinyl ether compound such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-O-propylene carbonate, dodecyl vinyl ether, diethylene glycol monovinyl ether and octadecyl vinyl ether.

The vinyl ether compound may be monofunctional or polyfunctional.

Specifically, examples of the monofunctional vinyl ether include methyl vinyl ether, ethyl vinyl ether, propyl vinyl ether, n-butyl vinyl ether, tert-butyl vinyl ether, 2-ethylhexyl vinyl ether, n-nonyl vinyl ether, lauryl vinyl ether, cyclohexyl vinyl ether, cyclohexylmethyl vinyl ether, 4-methylcyclohexylmethyl vinyl ether, benzyl vinyl ether, dicyclopentenyl vinyl ether, 2-dicyclopentenoxyethyl vinyl ether, methoxyethyl vinyl ether, ethoxyethyl vinyl ether, butoxyethyl vinyl ether, methoxyethoxyethyl vinyl ether, ethoxyethoxyethyl vinyl ether, methoxypolyethylene glycol vinyl ether, tetrahydrofurfuryl vinyl ether, 2-hydroxyethyl vinyl ether, 2-hydroxypropyl vinyl ether, 4-hydroxybutyl vinyl ether, 4-hydroxymethylcyclohexylmethyl vinyl ether, diethylene glycol monovinyl ether, polyethylene glycol vinyl ether, chloroethyl vinyl ether, chlorobutyl vinyl ether, chloroethoxyethyl vinyl ether, phenylethyl vinyl ether and phenoxypolyethylene glycol vinyl ether.

Examples of the polyfunctional vinyl ether include divinyl ethers such as ethylene glycol divinyl ether, diethylene glycol divinyl ether, polyethylene glycol divinyl ether, propylene glycol divinyl ether, butylene glycol divinyl ether, hexanediol divinyl ether, bisphenol A alkylene oxide divinyl ether and bisphenol F alkylene oxide divinyl ether; and polyfunctional vinyl ethers such as trimethylolethane trivinyl ether, trimethylolpropane trivinyl ether, ditrimethylolpropane tetravinyl ether, glycerin trivinyl ether, pentaerythritol tetravinyl ether, dipentaerythritol pentavinyl ether, dipentaerythritol hexavinyl ether, ethylene oxide-added trimethylolpropane trivinyl ether, propylene oxide-added trimethylolpropane trivinyl ether, ethylene oxide-added ditrimethylolpropane tetravinyl ether, propylene oxide-added ditrimethylolpropane tetravinyl ether, ethylene oxide-added pentaerythritol tetravinyl ether, propylene oxide-added pentaerythritol tetravinyl ether, ethylene oxide-added dipentaerythritol hexavinyl ether and propylene oxide-added dipentaerythritol hexavinyl ether.

As for the vinyl ether compound, a di- or trivinyl ether compound is preferred in view of curing property, adhesion to recording medium, surface hardness of image formed, or the like, and a divinyl ether compound is more preferred.

The oxetane compound as referred to in the present invention indicates a compound having an oxetane ring, and known oxetane compounds described, for example, in JP-A-2001-220526, JP-A-2001-310937 and JP-A-2003-341217 may be arbitrarily selected and used.

The compound having an oxetane ring, which can be used in the ink composition of the present invention, is preferably a compound having from one to four oxetane rings in the structure thereof. When such a compound is used, the viscosity of the ink composition can be easily maintained in the range allowing for good handling, and high adhesion can be obtained between the ink composition after curing and the recording medium.

Such a compound having an oxetane ring is described in detail in paragraphs [0021] to [0084] of JP-A-2003-341217, and compounds described therein can be suitably used also in the present invention.

Out of the oxetane compounds for use in the present invention, a compound having one oxetane ring is preferably used in view of viscosity and tackiness of the ink composition.

In the ink composition of the present invention, one of these cationic polymerizable compounds may be used alone, or two or more species thereof may be used in combination, but from the standpoint of effectively controlling the shrinkage on curing the ink, at least one compound selected from oxetane compounds and epoxy compounds is preferably used in combination with a vinyl ether compound.

The content of the (a) cationic polymerizable compound in the ink composition is suitably from 10 to 95 mass %, preferably from 30 to 90 mass %, more preferably from 50 to 85 mass %, based on the entire solid content of the composition.

(b) (Compound Capable of Generating an Acid upon Irradiation with Active Energy)

The ink composition of the present invention contains a compound capable of generating an acid upon irradiation with active energy (hereinafter appropriately referred to as a "photoacid generator").

The photoacid generator which can be used in the present invention may be appropriately selected from compounds capable of generating an acid upon irradiation with light (ultraviolet ray or far ultraviolet ray of 400 to 200 nm, preferably g-ray, h-ray, i-ray or KrF excimer laser light), ArF excimer laser light, electron beam, X-ray, molecular beam or ion beam, which are used in a photo-cationic polymerization photoinitiator, a photo-radical polymerization photoinitiator, a photo-decolorizing agent for coloring matters, a photo-discoloring agent, a micro resist or the like.

Examples of such a photoacid generator include an onium salt which decomposes upon irradiation with active energy to generate an acid, such as diazonium salt, ammonium salt, phosphonium salt, iodonium salt, sulfonium salt, selenonium salt and arsonium salt; an organic halogen compound; an organic metal/organic halide; an o-nitrobenzyl type protective group-containing photoacid generator; a compound capable of undergoing photodecomposition to generate a sulfonic acid, as represented by imino sulfonate; a disulfone compound; a diazoketosulfone; and a diazodisulfone compound.

Furthermore, for example, oxazole derivatives and s-triazine derivatives described in paragraphs [0029] to [0030] of JP-A-2002-122994 may also be suitably used as the photoacid generator. In addition, onium salt compounds and sulfonate-based compounds described in paragraphs [0037] to [0063] of JP-A-2002-122994 may also be suitably used as the photoacid generator in the present invention.

As for the (b) photoacid generator, one species may be used alone or two or more species may be used in combination.

The content of the (b) photoacid generator in the ink composition is preferably from 0.1 to 20 mass %, more preferably from 0.5 to 10 mass %, still more preferably from 1 to 7 mass %, based on the entire solid content of the ink composition.

(Colorant)

The ink composition of the present invention can form a visible image by adding thereto a colorant. For example, in the case of forming an image region of a lithographic printing plate, a colorant need not be necessarily added, but in view of suitability for plate inspection of the obtained lithographic printing plate, use of a colorant is also preferred.

The colorant which can be used here is not particularly limited, and various known coloring materials (pigment, dye) may be appropriately selected and used according to the usage. For example, in the case of forming an image with excellent weather resistance, a pigment is preferred. As for the dye, both a water-soluble dye and an oil-soluble dye may be used, but an oil-soluble dye is preferred.

(Pigment)

The pigment which is preferably used in the present invention is described below.

The pigment is not particularly limited and, for example, all organic and inorganic pigments generally available on the market, those obtained by dispersing a pigment in a dispersion medium such as insoluble resin, and those obtained by grafting a resin to the pigment surface may be used. In addition, those obtained by, for example, dyeing a resin particle with a dye may also be used.

Examples of such a pigment include pigments described in Seishiro Ito (compiler), *Ganryo No Jiten* (*Pigment Dictionary*), published in 2000, W. Herbst and K. Hunger, *Industrial Organic Pigments*, JP-A-2002-12607, JP-A-2002-188025, JP-A-2003-26978 and JP-A-2003-342503.

Specific examples of the organic and inorganic pigments which can be used in the present invention are as follows. Examples of the pigment which provides a yellow color include a monoazo pigment such as C.I. Pigment Yellow 1

(e.g., Fast Yellow G) and C.I. Pigment Yellow 74; a disazo pigment such as C.I. Pigment Yellow 12 (e.g., Disazo Yellow AAA) and C.I. Pigment Yellow 17; anon-benzidine-based azo pigment such as C.I. Pigment Yellow 180; an azo lake pigment such as C.I. Pigment Yellow 100 (e.g., Tartrazine Yellow Lake); a condensed azo pigment such as C.I. Pigment Yellow 95 (e.g., Condensed Azo Yellow GR); an acidic dye lake pigment such as C.I. Pigment Yellow 115 (e.g., Quinoline Yellow Lake); a basic dye lake pigment such as C.I. Pigment Yellow 18 (e.g., Thioflavine Lake); an anthraquinone-based pigment such as Flavanthrone Yellow (Y-24); an isoindolinone pigment such as Isoindolinone Yellow 3RLT (Y-110); a quinophthalone pigment such as Quinophthalone Yellow (Y-138); an isoindoline pigment such as Isoindoline Yellow (Y-139); a nitroso pigment such as C.I. Pigment Yellow 153 (e.g., Nickel Nitroso Yellow); and a metal complex salt azomethine pigment such as C.I. Pigment Yellow 117 (e.g., Copper Azomethine Yellow).

Examples of the pigment which provides a red or magenta color include a monoazo-based pigment such as C.I. Pigment Red 3 (e.g., Toluidine Red); a disazo pigment such as C.I. Pigment Red 38 (e.g., Pyrazolone Red B); an azo lake pigment such as C.I. Pigment Red 53:1 (e.g., Lake Red C) and C.I. Pigment Red 57:1 (Brilliant Carmine 6B); a condensed azo pigment such as C.I. Pigment Red 144 (e.g., Condensed Azo Red BR); an acidic dye lake pigment such as C.I. Pigment Red 174 (e.g., Phloxine B Lake); a basic dye lake pigment such as C.I. Pigment Red 81 (e.g., Rhodamine 6G' Lake); an anthraquinone-based pigment such as C.I. Pigment Red 177 (e.g., Dianthraquinonyl Red); a thioindigo pigment such as C.I. Pigment Red 88 (e.g., Thioindigo Bordeaux); a perinone pigment such as C.I. Pigment Red 194 (e.g., Perinone Red); a perylene pigment such as C.I. Pigment Red 149 (e.g., Perylene Scarlet); a quinacridone pigment such as C.I. Pigment Violet 19 (unsubstituted quinacridone) and C.I. Pigment Red 122 (e.g., Quinacridone Magenta); an isoindolinone pigment such as C.I. Pigment Red 180 (e.g., Isoindolinone Red 2BLT); and an alizarin lake pigment such as C.I. Pigment Red 83 (e.g., Madder Lake).

Examples of the pigment which provides a blue or cyan color include a disazo-based pigment such as C.I. Pigment Blue 25 (e.g., Dianisidine Blue); a phthalocyanine pigment such as C.I. Pigment Blue 15 (e.g., Phthalocyanine Blue); an acidic dye lake pigment such as C.I. Pigment Blue 24 (e.g., Peacock Blue Lake); a basic dye lake pigment such as C.I. Pigment Blue 1 (e.g., Victoria Pure Blue BO Lake); an anthraquinone-based pigment such as C.I. Pigment Blue 60 (e.g., Indanthrone Blue); and an alkali blue pigment such as C.I. Pigment Blue 18 (Alkali Blue V-5:1).

Examples of the pigment which provides a green color include a phthalocyanine pigment such as C.I. Pigment Green 7 (Phthalocyanine Green) and C.I. Pigment Green 36 (Phthalocyanine Green); and an azo metal complex pigment such as C.I. Pigment Green 8 (Nitroso Green).

Examples of the pigment which provides an orange color include an isoindoline-based pigment such as C.I. Pigment Orange 66 (Isoindoline Orange); and an anthraquinone-based pigment such as C. I. Pigment Orange 51 (Dichloropyranthrone Orange).

Examples of the pigment which provides a black color include carbon black, titanium black and aniline black.

Specific examples of the white pigment which can be used include basic lead carbonate ($2PbCO_3Pb(OH)_2$, so-called "silver white"), zinc oxide (ZnO, so-called "zinc white"), titanium oxide ($TiO_2$, so-called "titanium white"), strontium titanate ($SrTiO_3$, so-called "titanium strontium white").

Here, titanium oxide has a low specific gravity and a high refractive index and is chemically and physically stable as compared with other white pigments and therefore, this pigment ensures that the masking power and coloring power as a pigment are high and the durability against acid, alkali and other environments is excellent. Because of this, titanium oxide is preferably used as the white pigment. As a matter of course, other white pigments (may also be a white pigment other than those described above) may be used, if desired.

The pigment may be dispersed by using a dispersing device such as ball mill, sand mill, attritor, roll mill, jet mill, homogenizer, paint shaker, kneader, agitator, Henschel mixer, colloid mill, ultrasonic homogenizer, pearl mill and wet jet mill.

When dispersing the pigment, a dispersant may also be added. Examples of the dispersant include a hydroxyl group-containing carboxylic acid ester, a salt of long-chain polyaminoamide with high molecular weight acid ester, a salt of high molecular weight polycarboxylic acid, a high molecular weight unsaturated acid ester, a polymer copolymerization product, a modified polyacrylate, an aliphatic polyvalent carboxylic acid, a naphthalenesulfonic acid formalin condensate, a polyoxyethylene alkylphosphoric ester and a pigment derivative. A commercially available polymer dispersant such as Solsperse Series of Zeneca Ltd. may also be preferably used.

In addition, a synergist according to various pigments may be used as a dispersion aid. The dispersant or dispersion aid is preferably added in an amount of 1 to 50 parts by mass per 100 parts by mass of the pigment.

In the ink composition, a solvent may be added as a dispersion medium for various components such as pigment, or the (a) cationic polymerizable compound which is a low molecular weight component may be used as a dispersion medium without using a solvent. However, since the ink composition of the present invention is an active energy-curable ink and the ink is applied onto a recording medium and then cured, the ink composition is preferably solvent-free. This is because when a solvent remains in the cured ink image, the solvent resistance may deteriorate or the residual solvent may cause a problem of VOC (volatile organic compound). From such a standpoint, the (a) cationic polymerizable compound is preferably used as the dispersion medium. Above all, in view of dispersion suitability or enhancement of handling property of the ink composition, a cationic polymerizable monomer having a lowest viscosity is preferably selected.

The average particle diameter of the pigment is preferably from 0.02 to 4 μm, more preferably from 0.02 to 2 μm, still more preferably from 0.02 to 1.0 μm.

The pigment, dispersant, dispersion medium and dispersion or filtration conditions are selected or set so that the pigment particle can have an average particle diameter in the above-described preferred range. By this control of the particle diameter, clogging of the head nozzle can be suppressed and the storage stability, transparency and curing sensitivity of ink can be maintained.

(Dye)

The dye for use in the present invention is preferably an oil-soluble dye. Specifically, the oil-soluble dye means a dye having a solubility in water at 25° C. (mass of the coloring matter dissolved in 100 g of water) of 1 g or less. The solubility is preferably 0.5 g or less, more preferably 0.1 g or less. Accordingly, a so-called water-insoluble oil-soluble dye is preferably used.

As regards the dye for use in the present invention, it is also preferred to introduce an oil-solubilizing group into the mother nucleus of the above-described dye for the purpose of dissolving a necessary amount of dye in the ink composition.

Examples of the oil-solubilizing group include a long-chain or branched alkyl group, a long-chain or branched alkoxy group, a long-chain or branched alkylthio group, a long-chain or branched alkylsulfonyl group, a long-chain or branched acyloxy group, a long-chain or branched alkoxycarbonyl group, a long-chain or branched acyl group, a long-chain or branched acylamino group, a long-chain or branched alkylsulfonylamino group, a long-chain or branched alkylaminosulfonyl group; and an aryl group, an aryloxy group, an aryloxycarbonyl group, an arylcarbonyloxy group, an arylaminocarbonyl group, an arylaminosulfonyl group and an arylsulfonylamino group, each containing the above-described long-chain or branched substituent.

Furthermore, the dye may be obtained from a water-soluble dye having a carboxyl acid or a sulfonic acid through conversion into an oil-solubilizing group, that is, an alkoxycarbonyl group, an aryloxycarbonyl group, an alkylaminosulfonyl group or an arylaminosulfonyl group, by using a long-chain or branched alcohol, an amine, a phenol or an aniline derivative.

The oil-soluble dye preferably has a melting point of 200° C. or less, more preferably 150° C. or less, still more preferably 100° C. By using an oil-soluble dye having a low melting point, crystal precipitation of the coloring matter in the ink composition is suppressed and the ink composition comes to have good storage stability.

Furthermore, for the purpose of improving resistance against fading, particularly against an oxidative substance such as ozone, or enhancing the curing property, the oxidation potential is preferably noble (high). For this reason, the oil-soluble dye for use in the present invention preferably has an oxidation potential of 1.0 V (vs SCE) or more. A higher oxidation potential is preferred, and the oxidation potential is more preferably 1.1 V (vs SCE) or more, still more preferably 1.15 V (vs SCE) or more.

As for the dye of yellow color, compounds having a structure represented by formula (Y-I) of JP-A-2004-250483 are preferred.

Dyes represented by formulae (Y-II) to (Y-IV) described in paragraph [0034] of JP-A-2004-250483 are more preferred. Specific examples thereof include compounds described in paragraphs [0060] to [0071] of JP-A-2004-250483. Incidentally, the oil-soluble dye of formula (Y-I) described in the patent publication above may be used not only for yellow ink but also for ink of any color, such as black ink and red ink.

As for the dye of magenta color, compounds having a structure represented by formula (3) or (4) described in JP-A-2002-114930 are preferred. Specific examples thereof include the compounds described in paragraphs [0054] to [0073] of JP-A-2002-114930.

Azo dyes represented by formulae (M-1) to (M-2) described in paragraphs [0084] to [0122] of JP-A-2002-121414 are more preferred, and specific examples thereof include the compounds described in paragraphs [0123] to [0132] of JP-A-2002-121414. Incidentally, the oil-soluble dyes of formulae (3), (4) and (M-1) to (M-2) described in these patent publications may be used not only for magenta ink but also for ink of any color, such as black ink and red ink.

As for the dye of cyan color, dyes represented by formulae (I) to (IV) of JP-A-2001-181547 and dyes represented by formulae (IV-1) to (IV-4) described in paragraphs [0063] to [0078] of JP-A-2002-121414 are preferred. Specific examples thereof include the compounds described in paragraphs [0052] to [0066] of JP-A-2001-181547 and the compounds described in paragraphs [0079] to [0081] of JP-A-2002-121414.

Phthalocyanine dyes represented by formulae (C-I) and (C-II) described in paragraphs [0133] to [0196] of JP-A-2002-121414 are more preferred, and the phthalocyanine dye represented by formula (C-II) is still more preferred. Specific examples thereof include the compounds described in paragraphs [0198] to [0201] of JP-A-2002-121414. Incidentally, the oil-soluble dyes of formulae (I) to (IV), (IV-1) to (IV-4), (C-I) and (C-II) may be used not only for cyan ink but also for ink of any color, such as black ink and green ink.

Such a colorant is preferably added in an amount of, in terms of the solid content, from 1 to 20 mass %, more preferably from 2 to 10 mass %, based on the ink composition.

In the ink composition of the present invention, in addition to the above-described essential components, various additives may be used in combination according to the purpose. These arbitrary components are described below.

(Ultraviolet Absorbent)

In the present invention, an ultraviolet absorbent may be used from the standpoint of giving an image enhanced in the weather resistance and prevented from fading.

Examples of the ultraviolet absorbent include benzotriazole-based compounds described in JP-A-58-185677, JP-A-61-190537, JP-A-2-782, JP-A-5-197075 and JP-A-9-34057; benzophenone-based compounds described in JP-A-46-2784, JP-A-5-194483 and U.S. Pat. No. 3,214,463; cinnamic acid-based compounds described in JP-B-48-30492 (the term "JP-B" as used herein means an "examined Japanese patent application"), JP-B-56-21141 and JP-A-10-88106; triazine-based compounds described in JP-A-4-298503, JP-A-8-53427, JP-A-8-239368, JP-A-10-182621 and JP-T-8-501291 (the term (the term "JP-T" as used herein means a "published Japanese translation of a PCT patent application"); compounds described in *Research Disclosure*, No. 24239; and compounds capable of absorbing ultraviolet ray to emit fluorescence, so-called fluorescent brightening agent, as represented by a stilbene-based compound and a benzoxazole-based compound.

The amount of the ultraviolet absorbent added is appropriately selected according to the purpose but is generally on the order of 0.5 to 15 mass % in terms of the solid content.

(Sensitizer)

In the ink composition of the present invention, if desired, a sensitizer may be added for the purpose of enhancing the acid generation efficiency of the photoacid generator and shifting the photosensitive wavelength to a long wavelength side. The sensitizer may be any sensitizer as long as it can sensitize the photoacid generator by an electron or energy transfer mechanism. Preferred examples thereof include an aromatic polycondensed ring compound such as anthracene, 9,10-dialkoxyanthracene, pyrene and perylene; an aromatic ketone compound such as acetophenone, benzophenone, thioxanthone and Michler's ketone; and a heterocyclic compound such as phenothiazine and N-aryloxazolidinone. The amount of the sensitizer added is appropriately selected according to the purpose but is generally from 0.01 to 1 mol %, preferably from 0.1 to 0.5 mol %, based on the photoacid generator.

(Antioxidant)

An antioxidant may be added for the purpose of enhancing the stability of the ink composition. Examples of the antioxidant include those described in EP-A-223739, EP-A-309401, EP-A-309402, EP-A-310551, EP-A-310552, EP-A-459-416, German Unexamined Patent Publication No. 3435443, JP-A-54-48535, JP-A-62-262047, JP-A-63-113536, JP-A-63-

163351, JP-A-2-262654, JP-A-2-71262, JP-A-3-121449, JP-A-5-61166, JP-A-5-119449, and U.S. Pat. Nos. 4,814,262 and 4,980,275.

The amount of the antioxidant added is appropriately selected according to the purpose but is generally on the order of 0.1 to 8 mass % in terms of the solid content.

(Anti-Fading Agent)

In the ink composition of the present invention, various organic or metal complex-based anti-fading agents may be used. Examples of the organic anti-fading agent include hydroquinones, alkoxyphenols, dialkoxyphenols, phenols, anilines, amines, indanes, chromans, alkoxyanilines and heterocyclic compounds. Examples of the metal complex-based anti-fading agent include a nickel complex and a zinc complex, and specifically, there may be used the compounds described in patents cited in *Research Disclosure*, No. 17643, No. VII, Items I to J, ibid., No. 15162, ibid., No. 18716, page 650, left column, ibid., No. 36544, page 527, ibid., No. 307105, page 872, and ibid., No. 15162; and the compounds included in formulae of representative compounds and in examples of the compounds describe on JP-A-62-215272, pp. 127-137.

The amount of the anti-fading agent added is appropriately selected according to the purpose but is generally on the order of 0.1 to 8 mass % in terms of the solid content.

(Electrically Conducting Salts)

In the ink composition of the present invention, electrically conducting salts such as potassium thiocyanate, lithium nitrate, ammonium thiocyanate and dimethylamine hydrochloride may be added for the purpose of controlling the ejection physical property.

(Solvent)

In the ink composition of the present invention, addition of an organic solvent in an extremely small amount is also effective for the purpose of improving the adhesion to a recording medium.

Examples of the solvent include a ketone-based solvent such as acetone, methyl ethyl ketone and diethyl ketone; an alcohol-based solvent such as methanol, ethanol, 2-propanol, 1-propanol, 1-butanol and tert-butanol; a chlorine-based solvent such as chloroform and methylene chloride; an aromatic solvent such as benzene and toluene; an ester-based solvent such as ethyl acetate, butyl acetate and isopropyl acetate; an ether-based solvent such as diethyl ether, tetrahydrofuran and dioxane; and a glycol ether-based solvent such as ethylene glycol monomethyl ether and ethylene glycol dimethyl ether.

In this case, addition in the range of not causing a problem in the solvent resistance or VOC is effective, and this amount is preferably from 0.1 to 5 mass %, more preferably from 0.1 to 3 mass %, based on the entire ink composition.

(Polymer Compound)

In the ink composition of the present invention, various polymer compounds may be added for the purpose of adjusting the film physical properties. Examples of the polymer compound which can be used include an acryl-based polymer, a polyvinyl butyral resin, a polyurethane resin, a polyamide resin, a polyester resin, an epoxy resin, a phenol resin, a polycarbonate resin, a polyvinyl butyral resin, a polyvinyl formal resin, a shellac, a vinyl-based resin, an acryl-based resin, a rubber-based resin, waxes and other natural resins. Also, two or more species thereof may be used in combination. Among these, a vinyl-based copolymer obtainable by the copolymerization of an acryl-based monomer is preferred. In addition, as for the copolymerization composition of the polymer binder, a copolymer containing, as the structural unit, a "carboxyl group-containing monomer", an "alkyl methacrylate" or an "alkyl acrylate" is also preferably used.

(Surfactant)

In the ink composition of the present invention, a surfactant may also be added.

The surfactant includes those described in JP-A-62-173463 and JP-A-62-183457. Examples thereof include an anionic surfactant such as dialkylsulfosuccinates, alkylnaphthalenesulfonates and fatty acid salts; a nonionic surfactant such as polyoxyethylene alkyl ethers, polyoxyethylene alkylallyl ethers, acetylene glycols and polyoxyethylene-polyoxypropylene block copolymers; and a cationic surfactant such as alkylamine salts and quaternary ammonium salts. Incidentally, an organic fluoro compound may be used in place of the surfactant above. The organic fluoro compound is preferably hydrophobic. Examples of the organic fluoro compound include a fluorine-containing surfactant, an oily fluorine-containing compound (e.g., fluorine oil), a solid fluorine compound resin (e.g., tetrafluoroethylene resin), and those described in JP-B-57-9053 (columns 8 to 17) and JP-A-62-135826.

Other than these, for example, a leveling additive, a matting agent, waxes for adjusting the film physical properties, and a tackifier for improving adhesion to a recording medium such as polyolefin and PET, which does not inhibit the polymerization, may be added, if desired.

Specific examples of the tackifier include high molecular weight adhesive polymers described in JP-A-2001-49200, pp. 5-6 (for example, a copolymer comprising an ester of a (meth)acrylic acid and an alcohol containing an alkyl group having a carbon number of 1 to 20, an ester of a (meth) acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

(Radical Polymerization-Type Ink Composition)

The radical polymerization-type ink composition contains (d) a radical polymerizable compound, (e) a polymerization initiator and a colorant and, if desired, may further contain a colorant, a sensitizing dye, a co-sensitizer and the like.

The constituent components used in the radical polymerization-type ink composition are described below in sequence.

(d) (Radical Polymerizable Compound)

The radical polymerizable compound includes, for example, the following compound having an addition-polymerizable ethylenically unsaturated bond.

(Compound Having Addition-Polymerizable Ethylenically Unsaturated Bond)

Examples of the compound having an addition-polymerizable ethylenically unsaturated bond, which can be used in the ink composition of the present invention, include an ester of an unsaturated carboxylic acid (e.g., acrylic acid, methacrylic acid, itaconic acid, crotonic acid, isocrotonic acid, maleic acid) and an aliphatic polyhydric alcohol compound, and an amide of the above-described unsaturated carboxylic acid and an aliphatic polyvalent amine compound.

Specific examples of the ester monomer of an aliphatic polyhydric alcohol compound and an unsaturated carboxylic acid include the followings. Examples of the acrylic ester include ethylene glycol diacrylate, triethylene glycol diacrylate, 1,3-butanediol diacrylate, tetramethylene glycol diacrylate, propylene glycol diacrylate, neopentyl glycol diacrylate, trimethylolpropane triacrylate, trimethylolpropane tri(acryloyloxypropyl)ether, trimethylolethane triacrylate, hexanediol diacrylate, 1,4-cyclohexanediol diacrylate, tetraethylene glycol diacrylate, pentaerythritol diacrylate, pentaerythritol triacrylate, pentaerythritol tetraacrylate, dipentaerythritol diacrylate, dipentaerythritol hexaacrylate, sorbitol triacrylate, sorbitol tetraacrylate, sorbitol pentaacrylate, sorbitol hexaacrylate, tri(acryloyloxyethyl)isocyanurate, and polyester acrylate oligomer.

Examples of the methacrylic acid ester include tetramethylene glycol dimethacrylate, triethylene glycol dimethacrylate, neopentyl glycol dimethacrylate, trimethylolpropane trimethacrylate, trimethylolethane trimethacrylate, ethylene glycol dimethacrylate, 1,3-butanediol dimethacrylate, hexanediol dimethacrylate, pentaerythritol dimethacrylate, pentaerythritol trimethacrylate, pentaerythritol tetramethacrylate, dipentaerythritol dimethacrylate, dipentaerythritol hexamethacrylate, sorbitol trimethacrylate, sorbitol tetramethacrylate, bis[p-(3-methacryloxy-2-hydroxypropoxy)-phenyl]dimethylmethane, and bis[p-(acryloxyethoxy)phenyl]-dimethylmethane. Examples of itaconic acid ester include ethylene glycol diitaconate, propylene glycol diitaconate, 1,3-butanediol diitaconate, 1,4-butanediol diitaconate, tetramethylene glycol diitaconate, pentaerythritol diitaconate, and sorbitol tetraitaconate.

Examples of the crotonic acid ester include ethylene glycol dicrotonate, tetramethylene glycol dicrotonate, pentaerythritol dicrotonate, and sorbitol tetradicrotonate. Examples of the isocrotonic acid ester include ethylene glycol diisocrotonate, pentaerythritol diisocrotonate and sorbitol tetraisocrotonate. Examples of the maleic acid ester include ethylene glycol dimaleate, triethylene glycol dimaleate, pentaerythritol dimaleate and sorbitol tetramaleate. In addition, a mixture of these ester monomers may also be used. Specific examples of the amide monomer of an aliphatic polyvalent amine compound and an unsaturated carboxylic acid include methylenebis-acrylamide, methylenebis-methacrylamide, 1,6-hexamethylenebis-acrylamide, 1,6-hexamethylenebis-methacrylamide, diethylene triamine trisacrylamide, xylylenebisacrylamide, and xylylenebismethacrylamide.

Other examples include a vinyl urethane compound containing two or more polymerizable vinyl groups within one molecule, which is obtained by adding a hydroxyl group-containing vinyl monomer represented by the following formula (A) to a polyisocyanate compound containing two or more isocyanate groups within one molecule, described in JP-B-48-41708. $CH_2{=}C(R)COOCH_2CH(R')OH$ (A) (wherein R and R' each represents H or $CH_3$).

Still other examples include a functional acrylate or methacrylate such as urethane acrylates described in JP-A-51-37193, polyester acrylates described in JP-A-48-64183, JP-B-49-43191 and JP-B-52-30490, and epoxy acrylates obtained by reacting an epoxy resin and a (meth)acrylic acid. Furthermore, those described as a photocurable monomer or oligomer in *Journal of the Adhesion Society of Japan*, Vol. 20, No. 7, pp. 300-308 (1984) may also be used. In the present invention, these monomers can be used in a chemical form such as a prepolymer, namely, dimer, trimer or oligomer, or a mixture or copolymer thereof.

The amount of the radical polymerizable compound used is usually from 1 to 99.99%, preferably from 5 to 90.0%, more preferably from 10 to 70% ("%" as used herein indicates "mass %"), based on all components of the ink composition.

(e) (Photopolymerization Initiator)

The photopolymerization initiator for use in the radical polymerization-type ink composition of the present invention is described below.

The photopolymerization initiator as used in the present invention indicates a compound capable of undergoing a chemical change under the action of light or through interaction with the electron excited state of a sensitizing dye and thereby producing at least one species of a radical, an acid and a base.

Preferred examples of the photopolymerization initiator include (i) aromatic ketones, (ii) an aromatic onium salt compound, (iii) an organic peroxide, (iv) a hexaarylbiimidazole compound, (v) a ketoxime ester compound, (vi) a borate compound, (vii) an azinium compound, (viii) a metallocene compound, (vix) an active ester compound, and (x) a carbon-halogen bond-containing compound.

(Colorant)

A colorant the same as those described for the (c) colorant regarding the cationic polymerization-type ink composition may be utilized.

In the ink composition of the present invention, in addition to the above-described essential components, various additives may be used in combination according to the purpose. These arbitrary components are described below.

(Sensitizing Dye)

In the present invention, a sensitizing dye may be added for the purpose of improving the sensitivity of the photopolymerization initiator. Preferred examples of the sensitizing dye include those belonging to the following compounds and having an absorption wavelength in the region from 350 to 450 nm.

That is, the compounds are polynuclear aromatics (e.g., pyrene, perylene, triphenylene), xanthenes (e.g., fluorescein, eosin, erythrosin, Rhodamine B. Rose Bengale), cyanines (e.g., thiacarbocyanine, oxacarbocyanine), merocyanines (e.g., merocyanine, carbomerocyanine), thiazines (e.g., thionine, Methylene Blue, Toluidine Blue), acridines (e.g., Acridine Orange, chloroflavin, acriflavine), anthraquinones (e.g., anthraquinone), squaryliums (e.g., squarylium), and coumarins (e.g., 7-diethylamino-4-methylcoumarin).

(Co-Sensitizer)

Furthermore, in the ink of the present invention, a known compound having an activity of, for example, more enhancing the sensitivity or suppressing the polymerization inhibition by oxygen may be added as a co-sensitizer.

Examples of such a co-sensitizer include amines such as compounds described in M. R. Sander, et al., *Journal of Polymer Society*, Vol. 10, page 3173 (1972), JP-B-44-20189, JP-A-51-82102, JP-A-52-134692, JP-A-59-138205, JP-A-60-84305, JP-A-62-18537, JP-A-64-33104, and *Research Disclosure*, No. 33825. Specific examples thereof include triethanolamine, ethyl p-dimethylaminobenzoate, p-formyldimethylaniline and p-methylthiodimethylaniline.

Other examples include thiols and sulfides such as thiol compounds described in JP-A-53-702, JP-B-55-500806, and JP-A-5-142772 and disulfide compounds described in JP-A-56-75643. Specific examples thereof include 2-mercaptobenzothiazole, 2-mercaptobenzoxazole, 2-mercaptobenzimidazole, 2-mercapto-4(3H)-quinazoline and β-mercaptonaphthalene.

Still other examples include an amino acid compound (e.g., N-phenylglycine), organometallic compounds described in JP-B-48-42965 (e.g., tributyltin acetate), hydrogen donors described in JP-B-55-34414, sulfur compounds described in JP-A-6-308727 (e.g., trithian), phosphorus compounds described in JP-A-6-250387 (e.g., diethyl phosphite), and Si—H and Ge—H compounds described in Japanese Patent Application No. 6-191605.

Also, in view of enhancing the storability, a polymerization inhibitor is preferably added in an amount of 200 to 20,000 ppm. The ink for inkjet recording of the present invention is preferably ejected after heating it in the range from 40 to 80° C. and thereby decreasing the viscosity, and also for preventing head clogging due to thermal polymerization, addition of a polymerization inhibitor is preferred. Examples of the polymerization inhibitor include hydroquinone, benzoquinone, p-methoxyphenol, TEMPO, TEMPOL and cupferron Al.

(Others)

In addition, known compounds may be used as needed. For example, a surfactant, a leveling additive, a matting agent and, for adjusting the film physical properties, a polyester-based resin, a polyurethane-based resin, a vinyl-based resin, an acryl-based resin, a rubber-based resin or waxes, may be appropriately selected and used. Furthermore, in order to improve the adhesion to a recording medium such as polyolefin and PET, a tackifier which does not inhibit the polymerization is also preferably contained. Specific examples thereof include high molecular weight adhesive polymers described in JP-A-2001-49200, pp. 5-6 (for example, a copolymer comprising an ester of a (meth) acrylic acid and an alcohol containing an alkyl group having a carbon number of 1 to 20, an ester of a (meth)acrylic acid and an alicyclic alcohol having a carbon number of 3 to 14, or an ester of a (meth)acrylic acid and an aromatic alcohol having a carbon number of 6 to 14); and a low molecular weight tackifier resin having a polymerizable unsaturated bond.

Also, addition of an organic solvent in an extremely small amount is effective for the purpose of improving adhesion to a recording medium. In this case, addition in the range of not causing a problem in the solvent resistance or VOC is effective, and this amount is preferably from 0.1 to 5 mass %, more preferably from 0.1 to 3 mass %, based on the entire ink composition.

Furthermore, as the means for preventing reduction in the sensitivity due to light-shielding effect of the coloring material in the ink, it is also one preferred embodiment to form a radical/cation hybrid-type curing ink by combining a cationic polymerizable monomer having a long life as the polymerization initiator with a polymerization initiator.

(Aqueous Ink Composition)

The aqueous ink composition contains a polymerizable compound and a water-soluble photopolymerization initiator capable of generating a radical under the action of active energy and if desired, may further contain a coloring material and the like.

(Polymerizable Compound)

As for the polymerizable compound contained in the aqueous ink composition of the present invention, a polymerizable compound contained in known aqueous ink compositions may be used.

In the aqueous ink composition, a reactive material may be added so as to optimize the formulation by taking into account end user characteristics such as curing rate, adhesion and flexibility. For example, a (meth)acrylate (namely, acrylate and/or methacrylate) monomer or oligomer, an epoxide and an oxetane are used as such a reactive material.

Examples of the acrylate monomer include a phenoxyethyl acrylate, an octyldecyl acrylate, a tetrahydrofuryl acrylate, an isobornyl acrylate, a hexanediol diacrylate, a trimethylolpropane triacrylate, a pentaerythritol triacrylate, a polyethylene glycol diacrylate (e.g., tetraethylene glycol diacrylate), a dipropylene glycol diacrylate, a tri(propyleneglycol) triacrylate, a neopentyl glycol diacrylate, a bis(pentaerythritol) hexaacrylate, an acrylate of ethoxylated or propoxylated glycol and polyol (e.g., propoxylated neopentyl glycol diacrylate, ethoxylated trimethylolpropane triacrylate), and a mixture thereof.

Examples of the acrylate oligomer include an ethoxylated polyethylene glycol, an ethoxylated trimethylolpropane acrylate, a polyether acrylate including its ethoxylated product, and a urethane acrylate oligomer.

Examples of the methacrylate include a hexanediol dimethacrylate, a trimethylolpropane trimethacrylate, a triethylene glycol dimethacrylate, a diethylene glycol dimethacrylate, an ethylene glycol dimethacrylate, a 1,4-butanediol dimethacrylate, and a mixture thereof.

The amount of the oligomer added is preferably from 1 to 80 wt %, more preferably from 1 to 10 wt %, based on the entire weight of the ink composition.

(Water-Soluble Photopolymerization Initiator Capable of Producing a Radical Under the Action of Active Energy)

The polymerization initiator which can be used in the ink composition of the present invention is described below. As one example, a photopolymerization initiator up to a wavelength of around 400 nm may be used. Examples of such a photopolymerization initiator include photopolymerization initiators represented by the following formulae, which are a substance having functionality in a long wavelength region, namely, sensitivity of producing a radical when irradiated with ultraviolet rays (hereinafter simply referred to as a "TX system"). In the present invention, particularly, a photopolymerization initiator appropriately selected from these is preferably used.

TX-1:

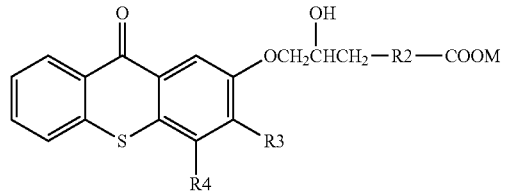

TX-2:

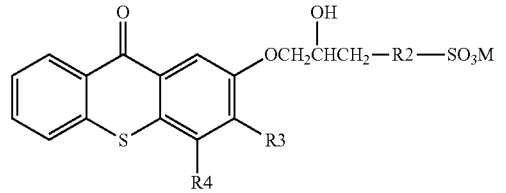

TX-3:

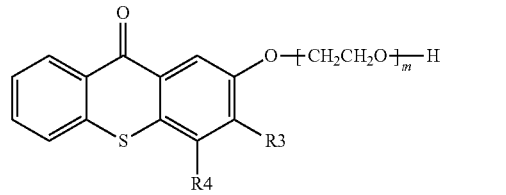

In formulae TX-1 to TX-3, R2 represents $—(CH_2)_x—$ (wherein x is 0 or 1), $—O—(CH_2)_y—$ (wherein y is 1 or 2), or a substituted or unsubstituted phenylene group. When R2 is a phenylene group, at least one of the hydrogen atoms in the benzene ring may be substituted by one group or atom or two or more groups or atoms selected from, for example, a carboxyl group or a salt thereof, a sulfonic acid or a salt thereof, a linear or branched alkyl group having a carbon number of 1 to 4, a halogen atom (e.g., fluorine, chlorine, bromine), an alkoxyl group having a carbon number of 1 to 4, and an aryloxy group such as phenoxy group. M represents a hydrogen atom or an alkali metal (e.g., Li, Na, K). R3 and R4 each independently represents a hydrogen atom or a substituted or unsubstituted alkyl group. Examples of the alkyl group include a linear or branched alkyl group having a carbon number of approximately from 1 to 10, particularly, a carbon number of approximately from 1 to 3. Examples of the substituent for this alkyl group include a halogen atom (e.g., fluorine, chlorine, bromine), a hydroxyl group, and an alkoxyl group (having a carbon number of approximately from 1 to 3). m represents an integer of 1 to 10.

In the present invention, a water-soluble derivative of a photopolymerization initiator, Irgacure 2959 (trade name, produced by Ciba Specialty Chemicals), represented by the following formula (hereinafter simply referred to as an "IC system") may be used. Specifically, IC-1 to IC-3 of the following formulae may be used.

Formula:

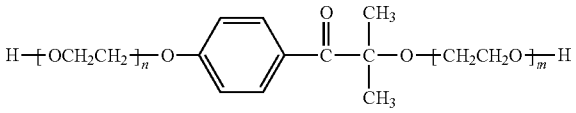

(n: 2 to 5, m: 0 to 5)

IC-1:

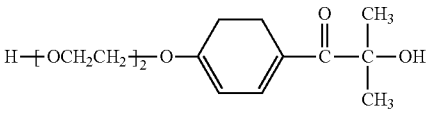

IC-2:

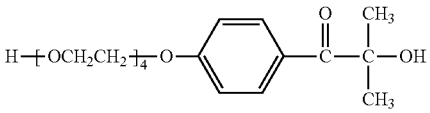

IC-3:

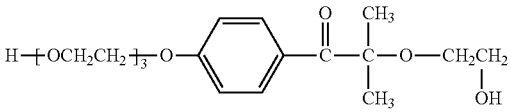

(Formulation for Clear Ink)

By using the water-soluble polymerizable compound in the form of a transparent aqueous ink without incorporating the above-described coloring material, a clear ink can be prepared. In particular, when the ink is prepared to have inkjet recording property, an aqueous photocuring-type clear ink for inkjet recording is obtained. This ink contains no coloring material and therefore, a clear film can be obtained by using the ink. Examples of the usage of the coloring material-free clear ink include use as an undercoat for imparting suitability for image printing to a recording material, and use as an overcoat for protecting the surface of an image formed by a normal ink or further imparting decoration, gloss or the like. In the clear ink, a colorless pigment, a fine particle or the like not for the purpose of coloration may be incorporated by dispersion according to the usage above. By this addition, various properties such as image quality, fastness and processability (handling property) of a printed matter can be enhanced in both cases of undercoat and overcoat.

As for the formulation conditions in such application to a clear ink, the ink is preferably prepared to contain a water-soluble polymerizable compound as the main component of the ink in a proportion of 10 to 85% and a photopolymerization initiator (for example, an ultraviolet polymerization catalyst) in an amount of 1 to 10 parts by mass per 100 parts by mass of the water-soluble polymerizable compound and at the same time, contain a photopolymerization initiator in an amount of at least 0.5 parts per 100 parts of the ink.

(Material Construction in Coloring Material-Containing Ink)

In the case of using the water-soluble polymerizable compound for a coloring material-containing ink, the concentrations of the polymerization initiator and polymerizable substance in the ink are preferably adjusted according to the absorption characteristics of the coloring material contained. As described above, the blending amount is set such that the amount of water or solvent is, on the mass basis, from 40 to 90%, preferably from 60 to 75%. Also, the content of the polymerizable compound in the ink is set to, on the mass basis, from 1 to 30%, preferably from 5 to 20%, based on the entire amount of the ink. The amount of the polymerization initiator depends on the content of the polymerizable compound but is generally, on the mass basis, from 0.1 to 7%, preferably from 0.3 to 5%, based on the entire amount of the ink.

In the case where a pigment is used as the coloring material of the ink, the concentration of the pure pigment portion in the ink is generally from 0.3 to 10 mass % based on the entire amount of the ink. The coloring power of the pigment depends on the dispersed state of pigment particles, but when the concentration is approximately from 0.3 to 1%, this is in the range of use as a light color ink, whereas the value exceeding the range above gives a concentration employed for normal coloration.

(Preferred Physical Properties of Ink Composition)

Taking into account the ejection property, the ink composition of the present invention preferably has an ink viscosity of 20 mPa·s or less, more preferably 10 mPa·s or less, at the ejection temperature, and an appropriate compositional ratio is preferably determined to give an ink viscosity in this range.

The surface tension in common of the ink composition of the present invention is preferably from 20 to 40 mN/m, more preferably from 25 to 35 mN/m. In the case of recording an image on various recording mediums such as polyolefins, PET, coated paper and non-coated paper, the surface tension is preferably 20 mN/m or more in view of bleeding and penetration and is preferably 40 mN/m or less in view of wettability.

The thus-prepared ink composition of the present invention is suitably used as an ink for inkjet recording. In the case of using the ink composition as an ink for inkjet recording, the ink composition is ejected on a recording medium by an inkjet printer and the ink composition ejected is then cured by irradiating thereon active energy, whereby recording is performed.

The printed matter obtained using this ink has an image area cured by the irradiation of active energy such as ultraviolet ray and is assured of excellent strength of the image area and therefore, the ink composition can be used for various uses such as formation of an ink-receiving layer (image area) of a lithographic printing plate, other than the formation of an image.

The present application claims foreign priority based on Japanese Patent Application (JP 2006-269250) filed Sep. 29 of 2006, the contents of which is incorporated herein by reference.

What is claimed is:

1. An inkjet recording apparatus comprising:

an inkjet head that ejects a liquid functional material toward a recording medium based on image signals;

a recording medium conveying unit that conveys the recording medium to a position opposing the inkjet head;

a supply path that supplies the liquid functional material to the inkjet head;

a reservoir that communicates the supply path, and that reserves the liquid functional material; and a degassing mechanism that is provided in one of the inkjet head, the supply path and the reservoir, and that includes a degassing device and a vacuum pump, wherein the degassing vacuum degree of the degassing mechanism is approximately 0.01 to 0.06 atm, further comprising:

a control interface (PC) that includes a table showing a relationship between a minimum boiling point of compounds contained in the liquid functional material and the degassing vacuum degree;

a pressure controller that controls a degassing vacuum degree of the degassing mechanism; and a vacuum gauge that measures the degassing vacuum degree of the degassing mechanism, wherein the control interface (PC) compares a value measured by the vacuum gauge with a target value, decides the target value based on the minimum boiling point, which is shown in the table, of the compounds of the liquid functional material, and controls the pressure controller to make coincident the value measured by the vacuum gauge with the target value.

2. The inkjet recording apparatus as claimed in claim 1, wherein the degassing vacuum degree of the degassing mechanism is approximately 0.06 atm.

3. The inkjet recording apparatus as claimed in claim 1, wherein the degassing vacuum degree of the degassing mechanism is approximately 0.04 atm.

4. The inkjet recording apparatus as claimed in claim 1, wherein the degassing vacuum degree of the degassing mechanism is approximately 0.03 atm.

5. The inkjet recording apparatus as claimed in claim 1, wherein the degassing vacuum degree of the degassing mechanism is approximately 0.02 atm.

6. The inkjet recording apparatus as claimed in claim 1, wherein the degassing vacuum degree of the degassing mechanism is approximately 0.01 atm.

7. The inkjet recording apparatus as claimed in claim 1, wherein the degassing vacuum degree of the degassing mechanism is determined by performing a proportional distribution based on a gradient of line connecting respective degassing vacuum degrees at nearest minimum boiling points above and below the minimum boiling point of the compound as determining object.

8. The inkjet recording apparatus as claimed in claim 1, wherein the liquid functional material comprises an ultraviolet-curable material.

9. The inkjet recording apparatus as claimed in claim 1, further comprising:

means of switching the degassing mechanism into a halt state.

10. The inkjet recording apparatus as claimed in claim 1, wherein the reservoir is provided with an air-feeding mechanism.

11. The inkjet recording apparatus as claimed in claim 1, further comprising:

an air-exposure valve disposed upstream of the inkjet head, the air-exposure valve is provided to expose the liquid functional material to air at the stoppage of image formation.

* * * * *